US005151731A

United States Patent [19]

Yamada et al.

[11] Patent Number: 5,151,731

[45] Date of Patent: Sep. 29, 1992

[54] PROCESSING SOLUTION REPLENISHMENT

[75] Inventors: Minoru Yamada, Minami-ashigara; Takashi Toyoda, Hatano, both of Japan

[73] Assignee: Fuji Photo Film Co., Ltd., Kanagawa, Japan

[21] Appl. No.: 600,365

[22] Filed: Oct. 19, 1990

[30] Foreign Application Priority Data

Oct. 20, 1989 [JP] Japan ..... 1-273304

[51] Int. Cl.[5] ..... G03D 3/02

[52] U.S. Cl. ..... 354/324

[58] Field of Search ..... 222/86, 85, 83, 88, 222/64, 143; 354/224, 297, 298, 323

[56] References Cited

U.S. PATENT DOCUMENTS 4,098,431 7/1978 Palmer et al. ..... 222/39
4,103,358 7/1978 Gacki et al. ..... 366/153
4,312,595 1/1982 Houseman et al. ..... 366/153
4,329,042 5/1982 Libicky et al. ..... 354/324

*Primary Examiner*—Michael L. Gellner
*Assistant Examiner*—D. Rutledge
*Attorney, Agent, or Firm*—Sughrue, Mion, Zinn, Macpeak & Seas

[57] ABSTRACT

For continuous development of X-ray film in a processing tank, a processing solution having a plurality of partial stocks diluted with water is replenished to the tank. The replenishing system includes a cartridge having discrete compartments partitioned therein and filled with the partial stocks and a storage tank having discrete compartments partitioned therein, wherein the partial stocks are transferred from the cartridge compartments into the storage tank compartments, respectively, and the partial stocks are then pumped from the storage tank compartments in amounts corresponding to a desired mix proportion of the partial stocks to the processing tank along with the diluent water.

17 Claims, 20 Drawing Sheets

PROCESSING SOLUTION REPLENISHMENT

This invention relates to a method and system for replenishing a processing solution to a tank for processing silver halide photosensitive material.

BACKGROUND OF THE INVENTION

Development of photosensitive material is generally carried out by dipping it in a processing solution in a tank of an automatic processor for a predetermined time. For continuous processing of a vast quantity of photosensitive material, a solution replenishing system is often employed to keep an effective composition of the processing solution in the tank. As a certain amount of photosensitive material is processed, a fresh processing solution referred to as a replenisher is replenished to the processing tank while the exhausted processing solution is forced out of the tank in an overflow manner.

Some prior art systems for preparing and replenishing such a replenisher are briefly described. FIG. 7 shows one exemplary system associated with an automatic processor for X-ray photosensitive material. The illustrated system is designed to prepare a developer replenisher and supply it to a developing tank 2 through which photosensitive material designated at S is passed. Three independent cartridges 4*a*, 4*b* and 4*c* are filled with three partial stocks A, B and C, respectively, which are admitted into a storage tank 12 along with a necessary volume of diluent water and agitated and mixed by a chemical mixer or the like to prepare a developer replenisher Q2. The replenisher Q2 in the storage tank 12 is fed to the processing or developing tank 2 as desired by means of a pump 13. At the same time, the exhausted solution exits the tank 2 through an overflow pipe 22. Similarly in a fixing tank, a fixer replenisher is prepared from two partial stocks and diluent water, stored in a storage tank, and pumped to the fixing tank as desired.

The chemical agents constituting the developer and fixer are stored in a plurality of partial stocks for the purposes of avoiding interaction therebetween, preventing deterioration with time, and insuring long term shelf storage.

This replenishing system undesirably requires a large space for installation because the storage tank 12 must have a large volume to store replenisher Q2. To meet the recently increasing demand for compact processors, it is desired to reduce the size of the replenisher storage tank.

Another replenishing system which was developed under such circumstances eliminated a replenisher storage tank. FIG. 8 shows such a replenishing system which is designed to directly feed partial stocks A, B and C from three independent stock cartridges 4*a*, 4*b* and 4*c* to a sump by means of feed pumps 14, 15 and 16, respectively, along with diluent water which is fed by means of a pump 17. The partial stocks A, B and C are mixed with diluent water in the sump to prepare a replenisher Q2, which is then fed to a processing or developing tank 2. Every time when the cartridges 4*a* to 4*c* become empty and are to be replaced, it is necessary to withdraw nozzles of feed tubes from the empty cartridges and connect them to new cartridges. This replacement operation is cumbersome. It seldom occurs that the partial stocks A, B and C are fully consumed at the same time without a remainder. One or two partial stocks can remain or be prematurely consumed probably because of the practical limit of accuracy of the pumps 14 to 16, but it is difficult to incorporate a correcting mechanism. It is undesirable to equip the cartridges 4*a*–4*c* with mechanisms for detecting the volume of remaining liquid because the cartridges are frequently replaced by new ones. Therefore, this system requires careful daily service and maintenance, eventually cumbersome operations and suffers from poor accuracy.

SUMMARY OF THE INVENTION

Therefore, an object of the present invention is to provide a method for replenishing a processing solution to a processing tank with efficiency and accuracy. Another object of the present invention is to provide a system for efficiently replenishing a processing solution to a processing tank, which allows the processing apparatus, in particular, a replenishing tank therein to be reduced in size while maintaining accuracy of replenishment of the processing solution.

According to the present invention, there is provided a method for replenishing a processing solution having a plurality of partial stocks diluted with a diluent to a processing tank, comprising the steps of:

providing a cartridge or container having discrete compartments partitioned therein and filled with the partial stocks in amounts corresponding to a desired mix proportion of the partial stocks, transferring the partial stocks from the cartridge compartments into discrete compartments partitioned in a storage tank, respectively, and pumping the partial stocks from the tank compartments in amounts corresponding to the desired mix proportion of the partial stocks to the processing tank along with the diluent.

With the organization of the present invention, since partial stocks are temporarily stored in the discrete storage tank compartments without dilution, the storage tank as a whole can be of a reduced capacity so that the overall apparatus may be reduced in size. The partial stocks are taken out of the storage tank compartments in amounts corresponding to the desired mix proportion of the partial stocks and fed to the processing tank along with the diluent, ensuring the accuracy of replenishment. Use of an integral cartridge having partial stocks contained in discrete compartments thereof provides ease of operation. Since partial stocks are contained in the cartridge compartments in amounts corresponding to the desired mix proportion of the partial stocks, the cartridge can be replaced in a cycle generally corresponding to the full consumption of the respective partial stocks, eliminating waste of partial stocks and alleviating replacement operations.

BRIEF DESCRIPTION OF THE DRAWINGS

The above and other objects, features, and advantages of the present invention will be better understood from the following description taken in conjunction with the accompanying drawings, in which.

Like parts are designated by the same reference numerals throughout the figures.

DESCRIPTION OF THE PREFERRED EMBODIMENTS

Figure 1:
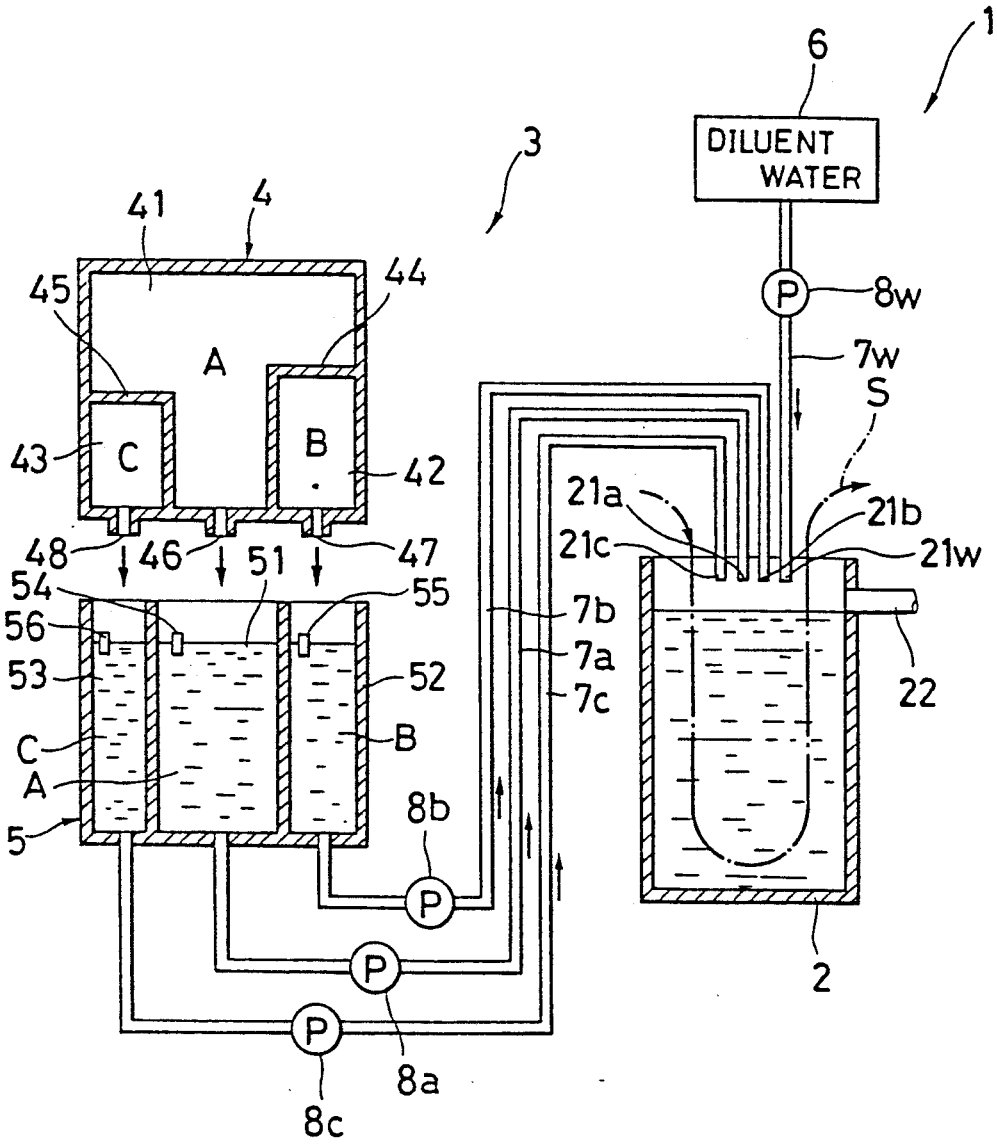
FIG. 1 schematically illustrates a system for replenishing a processing solution to a processing tank according to the present invention.

Referring to FIG. 1, there is schematically illustrated a portion of an apparatus for processing a photosensitive material in which a processing solution is replenished according to the method of the present invention. The photosensitive material processing apparatus generally designated at 1 includes a processing tank 2 for carrying out a selected type of processing such as development, fixation, bleach-fixation or washing. The processing tank 2 is provided with a feed port 21 for admitting a replenisher into the tank and a discharge port 22 for allowing exhausted processing solution to exit the tank in an overflow manner. The feed port includes four feed ports 21*a*, 21*b*, 21*c* and 21*w* in the illustrated embodiment. Because of the overflow discharge, the processing tank 2 is filled with the processing solution to the height where the discharge port 22 is located. Disposed inside and outside the processing tank 2 is mechanical transfer means, usually composed of transfer rollers and guides, for passing a photosensitive material S along a predetermined path (shown by a phantom line) for dipping it in the processing solution for a predetermined time although any components of the transfer means are not shown.

The apparatus 1 further includes a system generally designated at 3 for feeding a replenisher or replenishing a processing solution. The replenishing system 3 includes a cartridqe or container 4 filled with a plurality of partial chemical stocks from which the replenisher is formed, for example, partial stocks A, B and C in a separate fashion, a storage tank 5 for storing the partial stocks in a separate fashion, a source 6 for diluent or water, and delivery means including feed conduits and pumps. It will be understood that the system 3 is illustrated in an enlarged scale as compared with the processing tank 2.

The cartridge 4 for receiving chemical stocks therein has a housing with which partitions 44 and 45 define three discrete compartments or spaces 41, 42 and 43 for receiving partial stocks therein. The compartments 41, 42 and 43 are filled with partial stocks A, B and C, respectively. The amounts of partial stocks A, B and C filled in the compartments should correspond to a desired mixing proportion of the partial stocks to prepare a replenisher. Then the cycle of replacement of the cartridge 4 coincides with full consumption of the respective partial stocks, eliminating wasteful disposal of any partial stocks and alleviating replacement operations.

The cartridge 4 is provided with outlet ports 46, 47 and 48 in communication with the compartments 41, 42 and 43, respectively. When it is desired to shelf store the cartridge 4 having partial stocks A, B and C filled therein, caps or seals (not shown) are attached to the outlet ports 46, 47 and 48 to close the compartments 41, 42 and 43.

It is preferred to close the outlet ports 46, 47 and 48 with seals in the form of membranes. When it is desired to admit the partial stocks A, B and C from the cartridge 4 into the storage tank 5, the membranes attached to the outlet ports are perforated or broken by suitable unsealing means such as cutting edges, which are preferably provided on the storage tank 5 side and may have the same construction as chemical mixers known and currently used in X-ray photosensitive material processing, allowing the partial stocks A, B and C in the compartments 41, 42 and 43 to flow down. Then the partial stocks A, B and C can be easily and quickly transferred, from the cartridge 4 into the storage tank 5.

It will be understood that the cartridge 4 may be of any desired construction and configuration. It may be a housing integrally molded with partitions. An integral assembly may be prepared by separately molding discrete containers defining the compartments 41, 42 and 43 and joining the containers together. Alternatively, an integral assembly of three containers may be fabricated by molding a first container defining the compartment 41 having guide rails and separately molding two containers defining the compartments 42 and 43, and installing the last two containers to the first container through engagement with the guide rails.

The storage tank 5 includes three discrete storage compartments or sections 51, 52 and 53 defined in the interior thereof for storing the partial stocks A, B and C, respectively. At least one, preferably all of these storage sections 51, 52 and 53 are provided with level sensors 54, 55 and 56 for detecting the surface of liquid in the storage sections. The sensors may be connected to an indicator and an alarm (not shown) for indicating the necessity of replenishment of partial stocks as will be later described.

Figure 7:
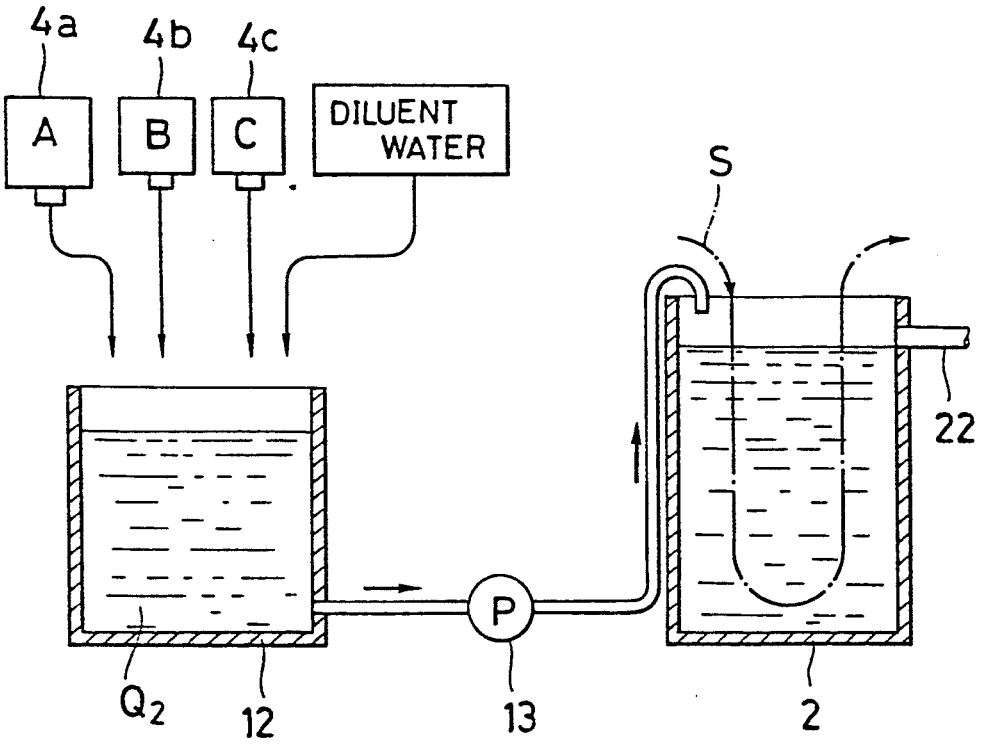
FIG. 7 PRIOR ART
FIG. 7 and 8 are schematic views of prior art replenishing systems.

As previously discussed, in the prior art as shown in FIG. 7, the stock in the diluted or final replenisher form is stored in the storage tank 12. The storage tank 12 must be of a considerably large volume to ensure continuity of replenishment. On the contrary, since the partial stocks are stored as such (in non-diluted form) in the storage tank 5 according to the present invention, the storage tank 5 can be of a reduced volume, contributing to the size reduction of the overall apparatus 1.

Figure 8:
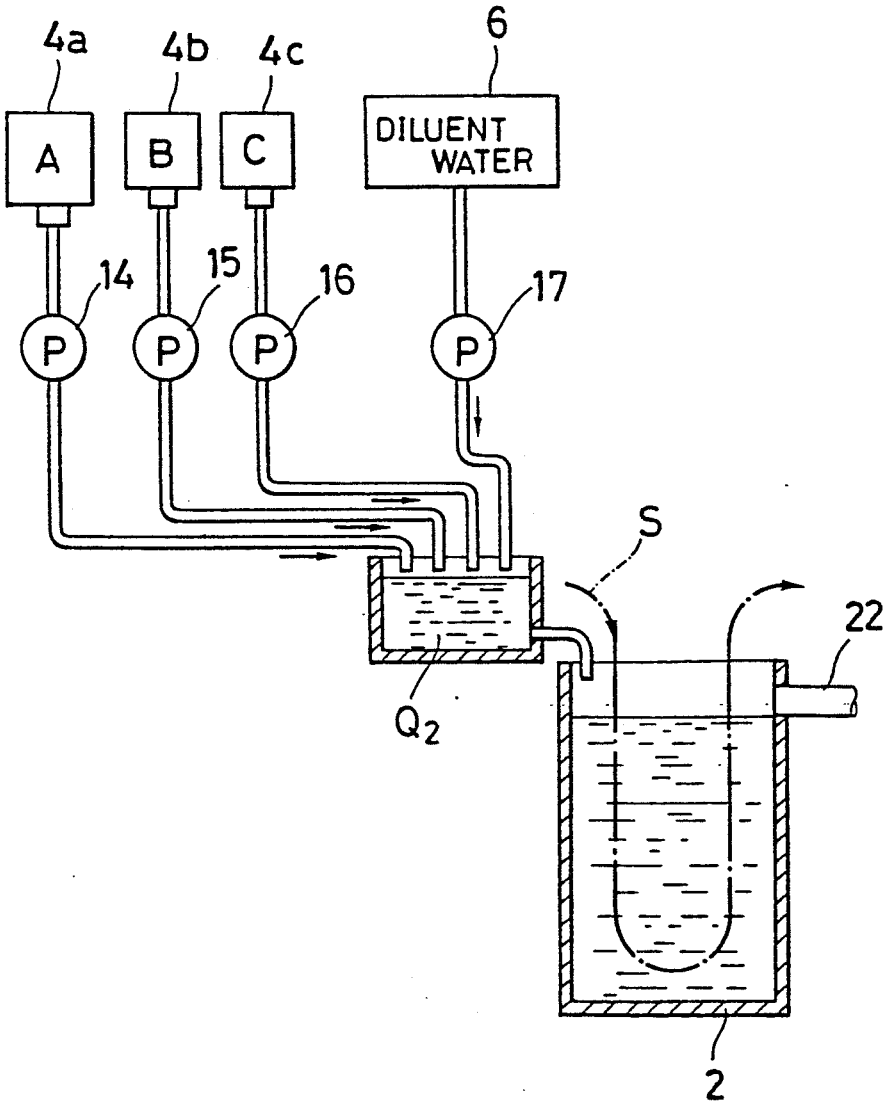

Also the prior art system of FIG. 8 is difficult to fully consume the partial stocks at the same time. Some partial stocks are left,.in one or more of the cartridges 4*a*–4*c* and discarded in vain. In addition, the nozzles of the feed tubes must be withdrawn from and connected to chemical stock cartridges 4*a*–4*c* whenever the cartridges are replaced by new ones. It is practically very difficult to incorporate level sensors in replacement cartridges.

On the contrary, since the partial stocks A, B and C are once transferred from the cartridge 4 into the storage tank 5 and then pumped to the processing tank 2 from the storage tank 5, the present invention offers many advantages that no liquid is left in the cartridge in vain, the stocks are fed in quantitatively accurate amounts, level sensors are easily provided in the storage tank, and the operation associated with replenishment of partial stocks becomes easier.

The storage tank 5 preferably has a total volume of about 2 to about 20 liters. To minimize the volume of the storage tank 5, desirably the volumes of the compartments 51, 52 and 53 correspond to the desired mixing proportion of the partial stocks A, B and C which are stored therein. The present invention is not limited thereto.

To the compartments 51, 52 and 53 of the storage tank 5 at the bottom are connected feed conduits 7*a*, 7*b* and 7*c* at one end, respectively. The other ends of the feed conduits 7*a*, 7*b* and 7*c* form the feed ports 21*a*, 21*b* and 21*c* to the processing tank 2, respectively. Pumps 8*a*, 8*b* and 8*c* are located intermediate the feed conduits 7*a*, 7*b* and 7*c*, respectively.

Another feed conduit 7*w* at one end is connected to a source 6 for diluent water and at another end forms the feed port 21*w* to the processing tank 2. A pump 8*w* is located intermediate the feed conduit 7*w*. In one preferred embodiment, the feed port 21*w* is located somewhat above the remaining feed ports 21*a*, 21*b* and 21*c* so that diluent water exiting from the feed port 21*w* may wash the remaining feed ports 21*a*, 21*b* and 21*c*.

The amount of partial stocks A, B and C fed through feed conduits 7*a*, 7*b* and 7*c*, that is, the discharge quantity of pumps 8*a*, 8*b* and 8*c* are controlled to correspond to the desired mixing proportion of partial stocks A, B add C. The amount of diluent water fed through feed conduit 7*w*, that is, the discharge quantity of pump 8*w* is controlled as necessary to dilute the partial stocks A, B and C from feed conduits 7*a*, 7*b* and 7*c* to the desired concentration to produce a replenisher solution. Then the desired replenisher is fed to the processing tank 2. The type of pumps 8*a*–8*c* and 8*w* is not particularly limited while bellows, roller, and diaphragm type pumps may be used.

The diluent water source 6 may be a tank filled with city water, ion-exchanged water, or distilled water, or a city water supply line with or without an ion-exchange filter. Fungicidal and bactericidal agents and any suitable additives may be added to diluent water as disclosed in, for example, Japanese Patent Application Nos. 63030/1986, 295894/1985, 51396/1986, 253807/1985, 233295/1986 and 91533/1989.

Now, the method for replenishing a processing solution to the photosensitive material processing apparatus 1 is described.

First, the seals on the outlet ports 46–48 of the cartridge 4 are perforated by cutting edges on the storage tank 5, allowing the partial stocks A–C in the cartridge compartments 41–43 to flow down into the corresponding storage tank compartments 51–53. Then the pumps 8*a*–8*c* are actuated to pump the partial stocks A–C from the storage tank compartments 51–53 through the feed conduits 7*a*–7*c* as shown by arrows. At the same time, the pump 8*w* is actuated to pump diluent water from the source 6 through the feed conduit 7*w* as shown by an arrow.

The partial stocks A–C in the feed conduits 7*a*–7*c* and the diluent water in the feed conduit 7*w* are fed into the processing tank 2 through the feed ports 21*a*–21*c* and 21*w*, respectively. The amounts of partial stocks A–C and diluent water fed are controlled to optimum values by the pumps 8*a*–8*c* and 8*w* so that the components are admitted into the processing tank 2 in sufficient amounts to form the desired replenisher.

The timing of such replenishment is not particularly limited, but preferably synchronized with processing of photosensitive material S. In processing photosensitive material in sheet form, replenishment is conducted in increments for every sheet or in bulk whenever a predetermined number of sheets have been processed. It is also possible to detect the duration of time when photosensitive material is processed and conduct replenishment in proportion to the detected duration.

Figure 2:
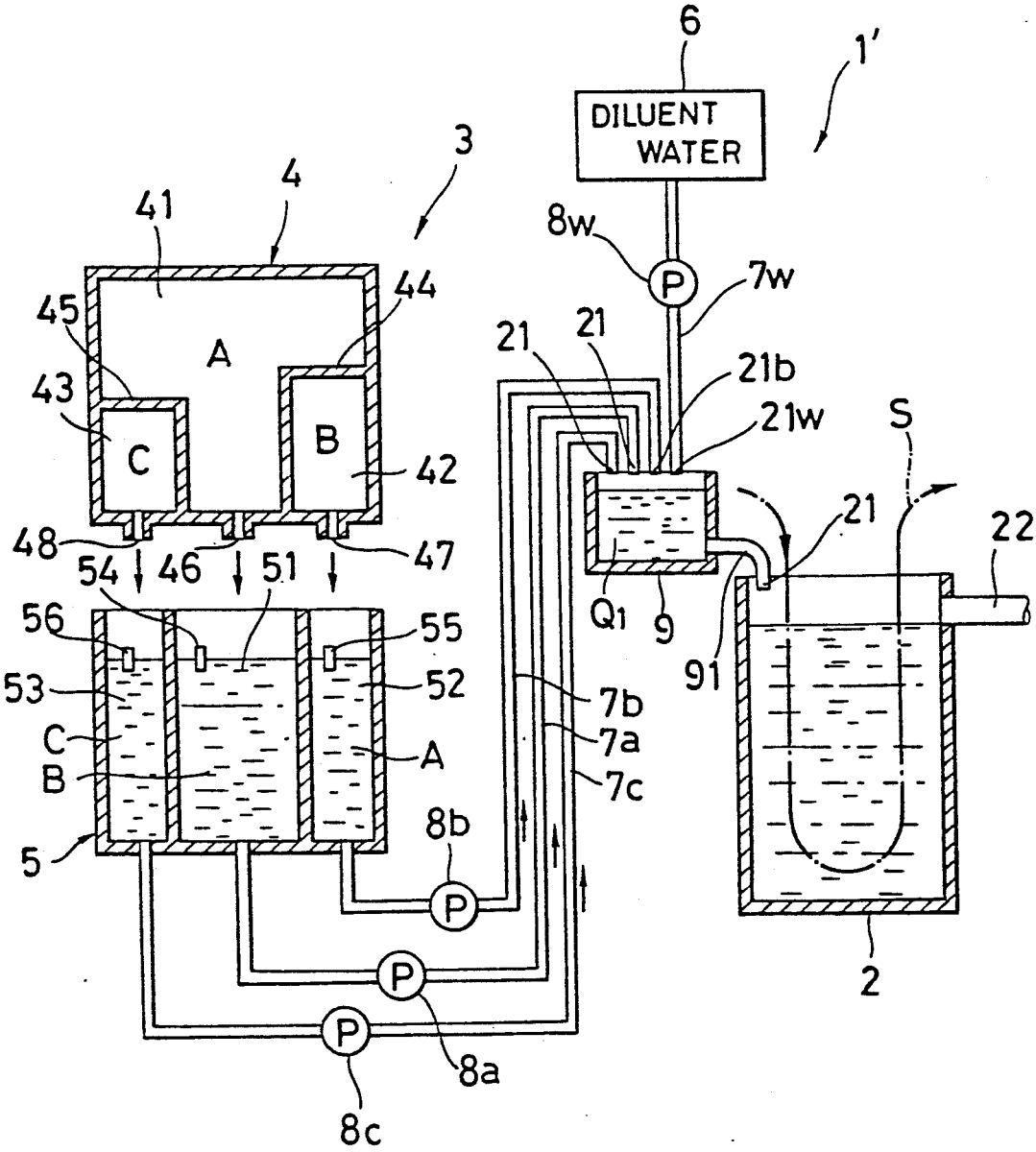
FIGS. 2, 3 and 5 are schematic views similar to FIG. 1 of modified systems.

FIG. 2 shows a modified version of the photosensitive material processing apparatus shown in FIG. 1. The apparatus generally designated at 1' includes an auxiliary tank 9 in which the discharge ends of the feed conduits 7*a*–7*c* and 7*w* are located. An additional feed conduit 91 at one end is connected to the auxiliary tank 9 near the bottom and at another end forms a feed port 21. A valve (not shown), especially an electromagnetic valve which is controllable for opening and closing timing, may be provided intermediate the feed conduit 91. The auxiliary tank 9 is separate from the processing tank 2 in the illustrated embodiment, but may be integrally molded with the latter.

Predetermined amounts of partial stocks A–C and diluent water are fed into the auxiliary tank 9 through the feed conduits 7*a*–7*c* and 7*w* where they are mixed to form the desired replenisher Q1. The replenisher Q1 is then passed through the feed conduit 91 and fed into the processing tank 2 through the feed port 21. The auxiliary tank 9 which acts as a buffer in the replenishing procedure may be of a reduced size as compared with the storage tank 5.

The photosensitive material processing apparatus 1 illustrated in FIG. 1 is designed such that the partial stocks A–C and diluent are directly admitted into the processing tank 2 whereas the apparatus 1' of FIG. 2 uses the auxiliary tank 9 located upstream of the processing tank 2 for premixing the partial stocks and water before entry to the processing tank 2 so that the replenisher as admitted to the tank 2 is more uniform, minimizing a local variation in the composition of the processing solution in the tank 2.

The remaining components of the apparatus 1' are the same as previously described for apparatus 1.

Figure 3:
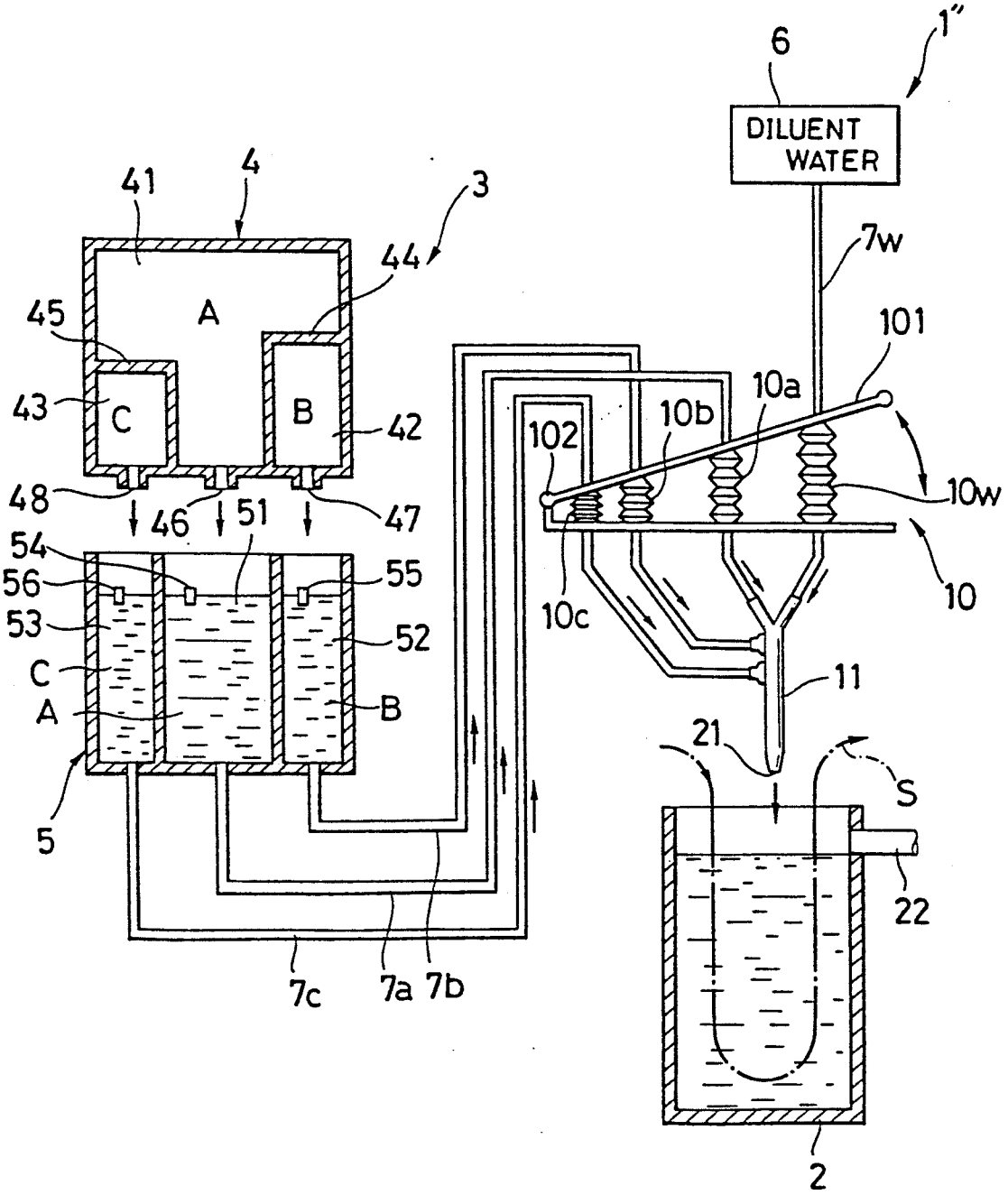

FIG. 3 shows another modified version of the photosensitive material processing apparatus shown in FIG. 1. The main difference of this apparatus 1'' is the construction of pumps. The pump used in conjunction with the feed conduits in this embodiment is a bellows pump assembly 10. More particularly, bellows 10*a*, 10*b*, 10*c* and 10*w* having check valves built therein (not shown) are located intermediate the feed conduits 7*a*, 7*b*, 7*c* and 7*w*. The bellows are secured at one end to a base plate and at another end to an arm 101 which is pivoted at 102 to the base plate. As the bellows are expanded and contracted by turning the arm 101 about the pivot 102 as shown by an arrow, the partial stocks A–C and diluent are fed in one direction by the action of the check valves in the bellows.

In this embodiment, the discharge amount of the bellows 10*a*–10*c* and 10*w*, that is, the feed amount of the partial stocks A–C and diluent are controlled by the stroke of the respective bellows, which correspond to the distance between the attachment of the respective bellows and the pivot 102.

The discharge amount of the bellows 10*a*–10*c* and 10*w* may also be controlled by adjusting the inner diameter of the respective bellows.

Figure 4:
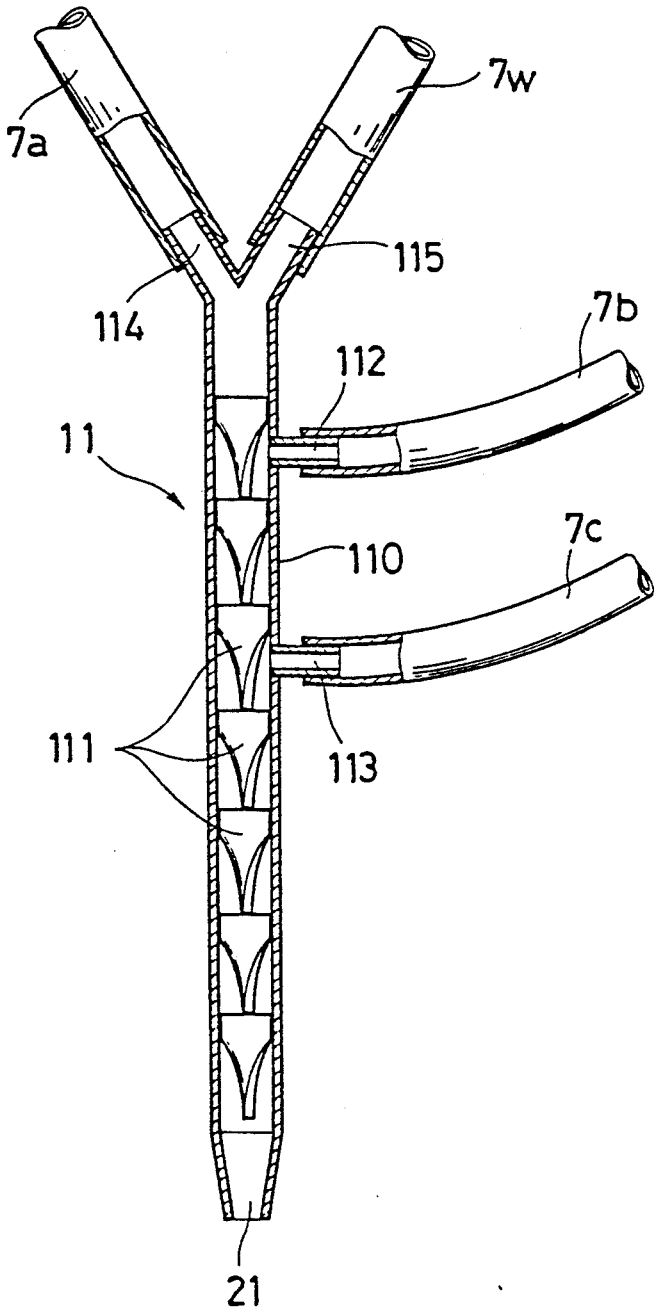
FIG. 4 is an axial cross-sectional view of a static mixer which is used in the embodiment of FIG. 3.

Disposed below the bellows pump 10 is means for mixing and agitating in the form of a static mixer 11. The detail of the static mixer 11 is shown in FIG. 4. The mixer 11 includes an elongated cylindrical tube 110 defining an interior flow path and having a convergent lower end defining a feed port 21. A plurality of agitator plates 111, each twisted by 90 degrees, are received in the cylindrical tube 110 in a multi-stage arrangement such that the edges of adjacent agitator plates are perpendicular to each other. The configuration, dimensions, and number of the twisted agitator plates 111 may be determined by taking into account the ability of mixing and agitating the partial stocks A–C with diluent. The cylindrical tube 110 on the peripheral wall is formed with longitudinally spaced apart inlet ports 112 and 113 which are coupled to the exit ends of feed conduits 7*b* and 7*c*, respectively. The cylindrical tube 110 at the top is formed with inlet ports 114 and 115 in a Y branch shape, which are coupled to the exit ends of feed conduits 7*a* and 7*w*, respectively. The static mixer 11 coupled to the exit ends of feed conduits 7*a*–7*c* and 7*w* serves to mix and agitate the partial stocks A–C and diluent therefrom to yield a replenisher with a uniform composition.

The static mixer of the construction shown in FIG. 4 permits any desired one of the partial stocks and diluent to be introduced in the interior flow path at a suitable location along the longitudinal direction thereof. The partial stocks and diluent can be mixed in an appropriate order.

Figure 5:
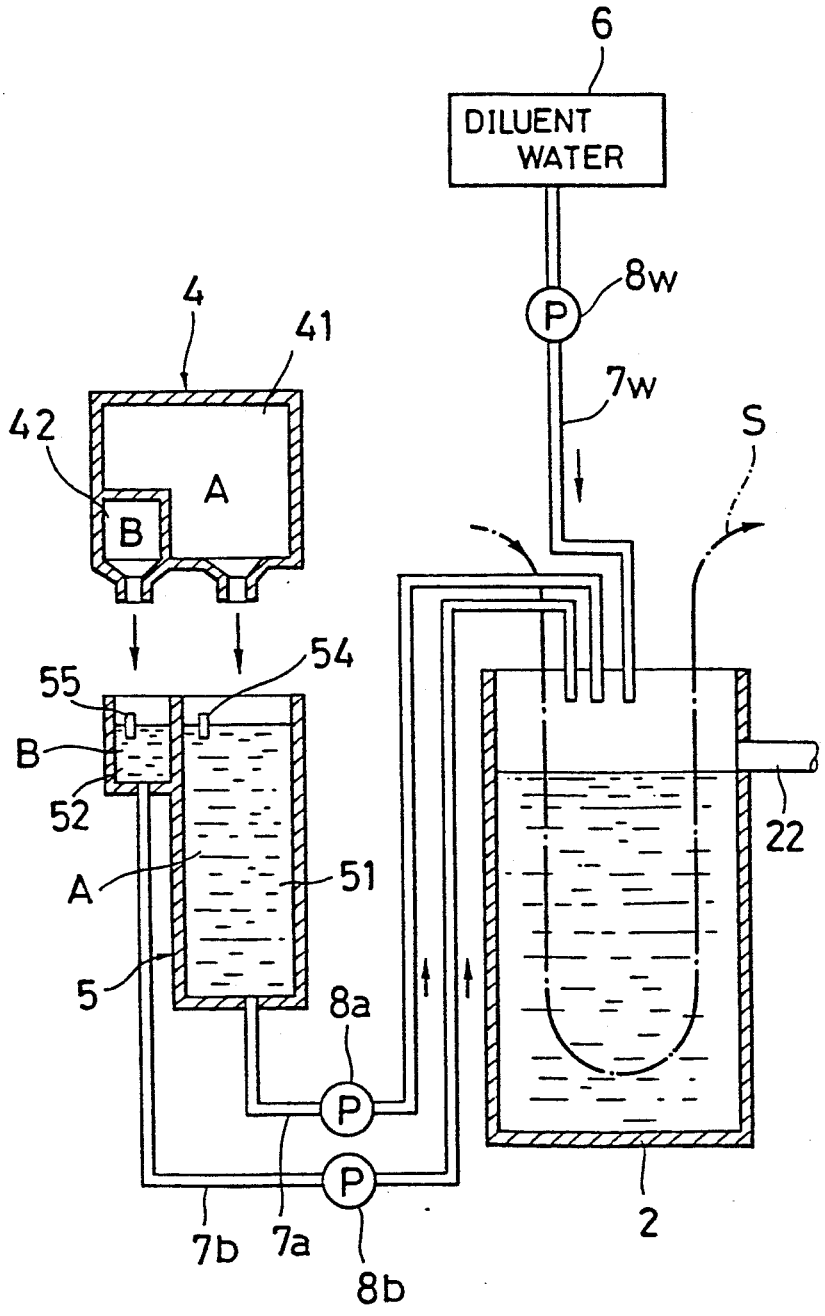

Although the photosensitive material processing apparatus 1, 1' and 1'' of FIGS. 1, 2 and 3 have been described as utilizing three partial stocks A, B and C, the number of partial stocks is not limited to three in the practice of the present invention. Where two partial stocks A and B are utilized, for example, the line associated with partial stock C (including compartments, conduit and pump) can be omitted. Such a system for handling two partial stocks is illustrated in FIG. 5. The chemical cartridge 4 has two compartments 41 and 42 for receiving partial stocks A and B, respectively, and the storage tank 5 has two storage compartments 51 and 52 corresponding thereto. Feed conduits 7*a* and 7*b* extend from the storage compartments 51 and 52 to the processing tank 2. Pumps 8*a* and 8*b* are located intermediate the feed conduits 7*a* and 7*b*, respectively. Where four partial stocks A, B, C and D are utilized, an additional line associated with partial stock D (including compartments, conduit and pump) should be installed.

Figure 6:
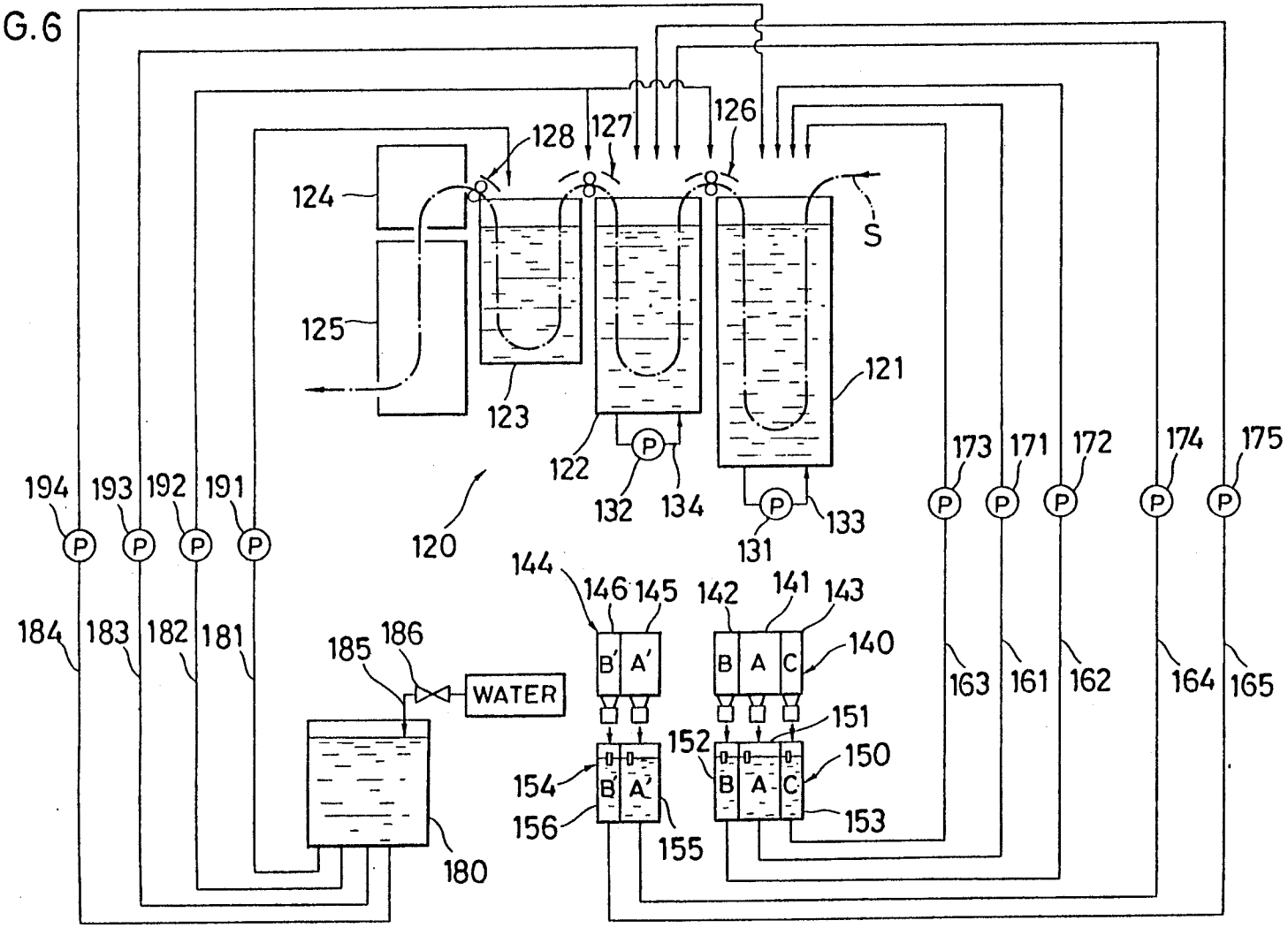
FIG. 6 is a view schematically showing the overall arrangement of an automatic processor having incorporated therein replenishing systems for replenishing processing solutions according to the present invention.

FIG. 6 illustrates one embodiment of an overall replenishing system for replenishing partial stocks and water to developing, fixing and washing tanks 121, 122 and 123 of an automatic processor 120 according to the present invention.

As schematically shown in FIG. 6, the automatic processor 120 includes a developing tank 121, a fixing tank 122, a washing tank 123, a squeezer section 124, and a dryer section 125 arranged in side-by-side fashion. The tanks 121–123 are provided with transfer means in the form of a rack having rollers and guides for passing a sheet of photosensitive material depicted by S along a predetermined path as shown by a phantom line, though the transfer means are not shown. Crossover racks 126, 127 and 128 are located at the interface between the respective tanks. The developing, fixing and washing tanks 121, 122 and 123 are filled with developer, fixer and wash solutions, respectively. The developer in the developing tank 121 is circulated through a conduit 133 connected at opposite ends to the bottom of the tank and having a pump 131 inserted therein. Similarly, the fixer in the fixing tank 122 is circulated through a conduit 134 connected at opposite ends to the bottom of the tank and having a pump 132 inserted therein.

After the processor 120 is loaded with an exposed photosensitive material S, it is successively transferred through developing tank 121, fixing tank 122, washing tank 123, squeezer section 124 and dryer section 125 where it is subject to development, fixation, water washing, water removal, and drying.

The processor 120 has incorporated therein a replenishing system or a system for feeding replenishers. Since this replenishing system may be substantially the same as any one of FIGS. 1, 2, 3, and 5, it is briefly described. As shown in FIG. 6, the replenishing system includes a storage tank 150 for developer replenishment having three compartments 151, 152 and 153 for storing three partial stocks of the developer and a storage tank 154 for fixer replenishment having two compartments 155 and 156 for storing two partial stocks of the fixer.

Disposed above the developer storage tank 150 is a cartridge 140 having integrally assembled three compartments or partial containers 141, 142 and 143 filled with three partial stocks A, B and C of the developer, respectively. Disposed above the fixer storage tank 154 is a cartridge 144 having integrally assembled two compartments or partial containers 145 and 146 filled with two partial stocks A' and B' of the fixer, respectively. The partial stocks A, B and C are fed from the compartments or partial containers 141, 142 and 143 of the cartridge 140 into the corresponding storage compartments 151, 152 and 153 of the storage tank 150. Similarly, the partial stocks A' and B' are fed from the compartments or partial containers 145 and 146 of the cartridge 144 into the corresponding storage compartments 155 and 156 of the storage tank 154.

Feed conduits 161, 162 and 163 having pumps 171, 172 and 173 inserted therein extend from the storage compartments 151, 152 and 153 of the storage tank 150 to the developing tank 121, respectively. By actuating the pumps 171, 172 and 173, the partial stocks A, B and C are fed to the developing tank 121. Similarly, feed conduits 164 and 165 having pumps 174 and 175 inserted therein extend from the storage compartments 155 and 156 of the storage tank 154 to the fixing tank 122, respectively. By actuating the pumps 174 and 175, the partial stocks A' and B' are fed to the fixing tank 122.

The replenishing system further includes a water storage tank 180 serving as a source for feeding diluent water. To the water storage tank 180 are connected conduits 181, 182, 183 and 184 having pumps 191, 192, 193 and 194 inserted therein. The conduit 181 extends to the wash tank 123 for replenishing water thereto, the conduit 182 extends to above the crossover racks 126 and 127 for washing them with water, and the conduits 183 and 184 extend to the fixing and developing tanks 122 and 121, respectively, for replenishing diluent water thereto. In turn, the water storage tank 180 receives city water from a city water source through a conduit 185 as needed under the control of a valve 186, for example, by detecting the volume of water in the tank 180 to find that the volume drops below a predetermined level.

One preferred embodiment of the system for feeding replenishers to a photosensitive material processing apparatus in the practice of the present invention is described in detail. The apparatus is of the type having a plurality of serially arranged processing tanks filled with processing solutions wherein a photosensitive material is processed by successively passing it through the plurality of processing tanks. A corresponding plurality of replenishing systems are associated with the plurality of processing tanks. One typical replenishing system includes an integrated container or cartridge defining a plurality of compartments filled with a plurality of partial stocks received in a separated manner, a storage tank having a corresponding plurality of compartments, means for separately feeding the partial stocks from the cartridge compartments to the storage tank compartments in a chicken hopper manner, and means for feeding the partial stocks from the storage tank compartments to the processing tank along with diluent water, thereby replenishing the processing solution to the tank. The system further includes a corresponding plurality of detector means attached to the plurality of storage tank compartments for detecting the level of the respective partial stocks therein, an indicator means for indicating the necessity of replacement of the cartridge in response to the detection signals of the detector means, and a control means electrically connected to the detector means for receiving the detection signals therefrom, for forcedly emptying the cartridge compartments of the residual partial stocks when at least one of the levels of the partial stocks detected by the detector means is below its predetermined value, and for actuating the indicator means after all the levels of the partial stocks detected by the detector means are below their predetermined values. Preferably, the system further includes an alarm means for alarming the replacement of the cartridge, and the control means is adapted to actuate the alarm means after a predetermined amount of photosensitive material has been processed since the indicator means was actuated.

According to this embodiment of the replenishing system, when at least one of the levels of the partial stocks in the storage tank compartments detected by the detector means is below its predetermined value, the remaining cartridge compartments are forcedly emptied of the residual partial stocks. After all the levels of the partial stocks in the storage tank compartments detected by the detector means are below their predetermined values, the indicator means is actuated. With the use of means for separately feeding the partial stocks from the cartridge to the storage tank compartments in a chicken hopper manner, or simply with the use of a chicken hopper type cartridge, as the level of the partial stock or liquid in the corresponding storage tank compartment lowers, the partial stock in the cartridge compartment is fed to the storage tank compartment. Therefore, when the level of the partial stock or liquid in the storage tank compartment is below the predetermined value, there remains no partial stock in the corresponding cartridge compartment. When the indicator means is actuated, there remains partial stock or liquid in none of the cartridge compartments. Thus the operator can notice the necessity of replacement of the cartridge.

Since all the cartridge compartments are emptied of the respective partial stocks when the indicator means is actuated, there is no risk of contamination of the surrounding apparatus upon replacement of the cartridge.

Since the alarm means is actuated when a predetermined amount of photosensitive material has been processed after actuation of the indicator means, the necessity of replacement of the cartridge is timely noticed to the operator by both the indicator means and the alarm means. The operator will readily expect the proper timing of replacing the cartridge. If the predetermined amount is a critical amount beyond which no further photosensitive material can be effectively processed, the operator will readily find the proper cartridge replacing point of time.

This embodiment of the replenisher feeding system associated with the photosensitive material processing apparatus will be better understood from a reading of the following description taken in conjunction with FIGS. 9 to 20.

Figure 9:
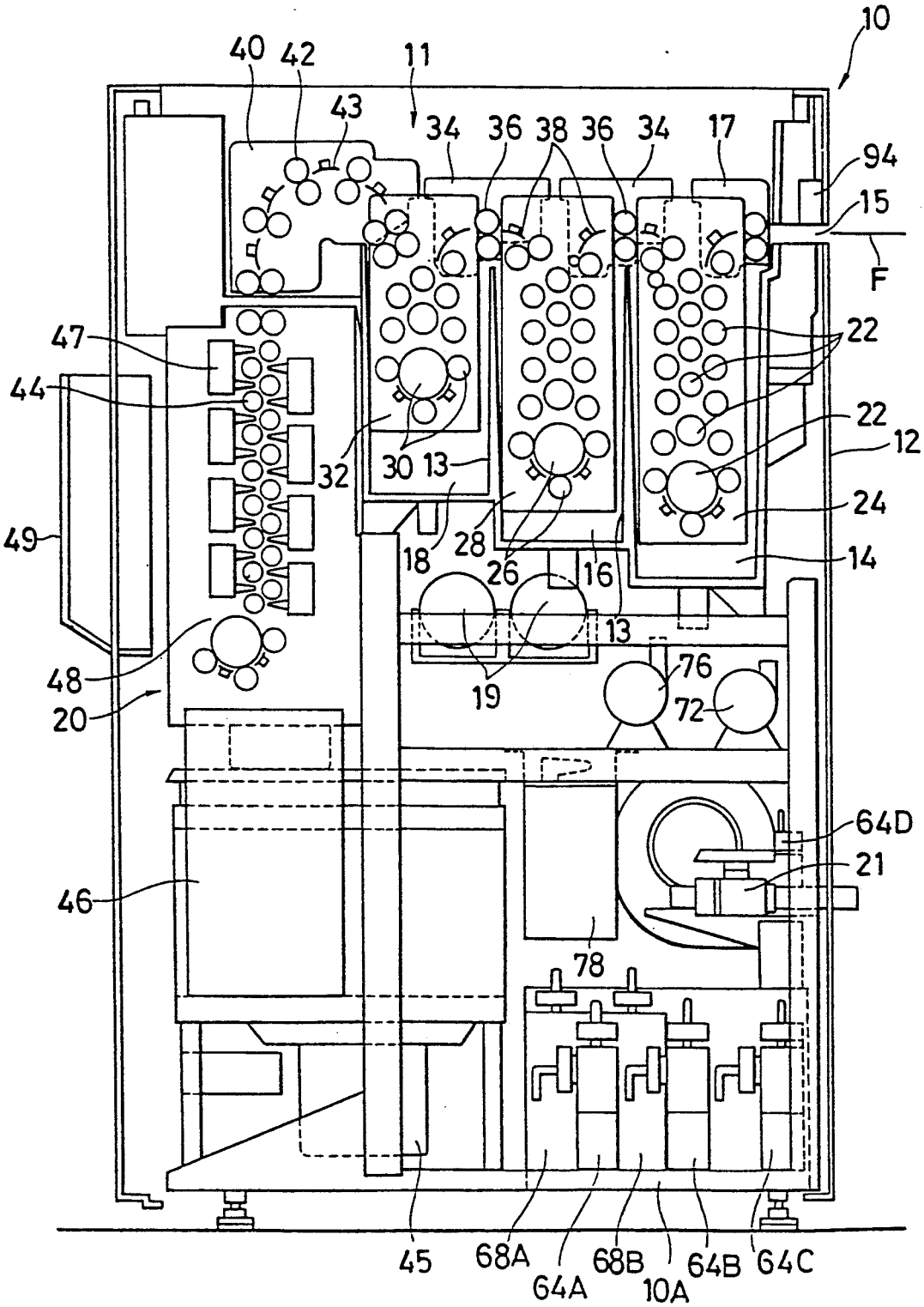
FIG. 9 is a vertical cross-sectional view of an automatic processor to which the present invention is applied.

Referring to FIG. 9, an automatic processor generally depicted at 10 includes a processing section 11 and a drying section 20 within a frame 12. The processing section 11, in turn, includes a series of a developing tank 14, a fixing tank 16 and a washing tank 18 defined by partitions 13 and arranged in a travel direction of a length or sheet of photosensitive material in the form of a film F in the illustrated embodiment. Disposed near an entrance slit 15 of film F to the processor 10 is a loading rack 17 for taking film F into the processor. Also disposed adjacent the entrance 15 is a sensor 94 for detecting the entry of film F. The processor 10 adjacent the entrance slit 15, but on the outside, may be provided with an entrance platform along which film F is manually slid into the processor or an automatic loader for automatically feeding film F into the processor.

The developing tank 14 is filled with a liquid developer, and a transfer rack 24 including transfer rollers 22 driven by a motor (not shown) for transferring film F along a predetermined (U-shaped in the illustrated embodiment) path is disposed in the tank such that the rack is immersed in the developer. Similarly, the fixing tank 16 is filled with a liquid fixer, and a transfer rack 28 including transfer rollers 26 driven by a motor (not shown) for transferring film F along a predetermined (U-shaped in the illustrated embodiment) path is disposed in the tank such that the rack is immersed in the fixer. Further, the washing tank 18 is filled with wash water, and a transfer rack 32 including transfer rollers 30 driven by a motor (not shown) for transferring film F along a predetermined (U-shaped in the illustrated embodiment) path is disposed in the tank such that the rack is immersed in the wash water.

Disposed below the developing and fixing tanks 14 and 16 are heat exchangers 19 and 19. The liquid developer and fixer in the developing and fixing tanks 14 and 16 are fed to the respective heat exchangers 19 and 19 where heat exchange takes place and thereafter, back to the developing and fixing tanks 14 and 16. The liquid developer and fixer in the developing and fixing tanks 14 and 16 are then maintained at temperatures within the predetermined ranges.

Crossover racks 34 are disposed above the interface between the developing and fixing tanks 14 and 16 and between the fixing and washing tanks 16 and 18. Each crossover rack 34 includes clamping transfer rollers 36 and guides 38 for transferring and guiding film F from an upstream tank to a downstream tank in the travel direction of film F.

The film F loaded into the processor 10 through the entrance slit 15 is introduced into the developing tank 14 from the loading rack 17 and passed through the developer in the developing tank 14 with the aid of the transfer rollers 22 where it is subject to development. The developed film F is fed from the developing tank 14 to the fixing tank 16 through the crossover rack 34 and passed through the fixer in the fixing tank 16 with the aid of the transfer rollers 26 where it is subject to fixation. The fixed film F is fed from the fixing tank 16 to the washing tank 18 through the crossover rack 34 and passed through the wash water in the washing tank 18 with the aid of the transfer rollers 30 where it is washed with water. The film F is processed in this way.

It will be understood that the developing, fixing and washing tanks 14, 16 and 18 at the bottom are connected to one end of discharge conduits (not shown) which at the other end are connected to exit valves 21. By opening the exit valves 21 when desired, the developer liquid in the developing tank 14, the fixer liquid in the fixing tank 16 and the wash water in the washing tank 18 can be discharged.

Disposed between the washing tank 18 and the drying section 20 is a squeeze rack 40, which includes plural pairs of transfer/squeeze rollers 42 and guides 43 for feeding and guiding the film F to the drying section 20 while squeezing off the accompanying water.

The drying section 20 includes a series of transfer rollers 44 arranged along the travel path of film F for transferring film F vertically downward, a fan 45 disposed near the bottom of the frame for blowing drying air, a chamber 46 having heater built therein for heating the drying air, and spargers 47 in flow communication with the chamber 46 for spraying heated drying air to the film F and transfer rollers 44. Disposed downstream of the last one of the transfer rollers 44 along the film travel path is a turning roller assembly 48 where the film F is turned obliquely upward.

The processor 10 is provided with a film receptacle 49 located in the frame wall and half projecting from the frame wall for receiving film F from the turning roller assembly 48.

The film F which has been squeezed by means of the squeeze rack 40 is moved downward by the transfer rollers 44 heated with the hot air while it is dried with the hot air injected from spargers 47. Thereafter, the film F is turned upward by the turning assembly 48 and directed to the receptacle 49 where it is accommodated.

Figure 10:
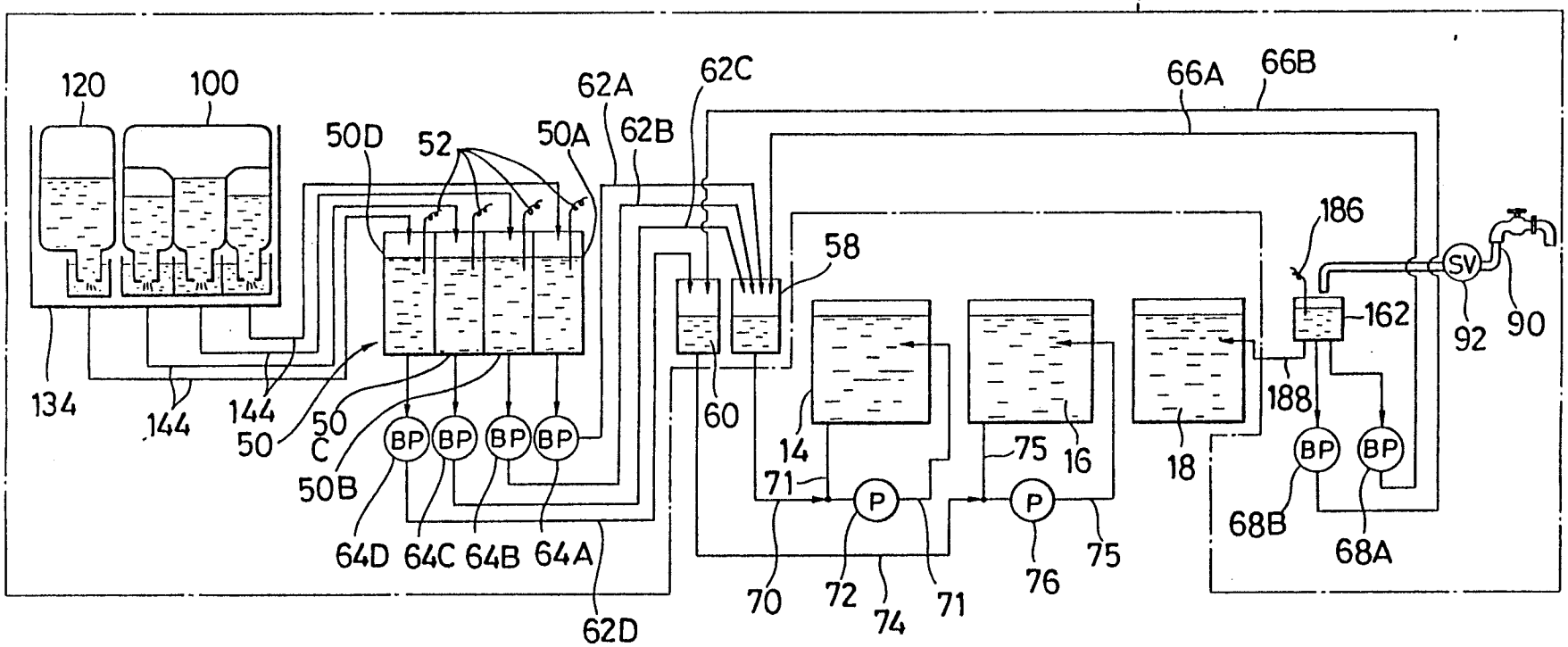
FIG. 10 schematically illustrates the systems for feeding replenishers to the processing tanks of the processor of FIG. 9.

FIG. 10 illustrates a system for feeding replenishers to the photosensitive material processing apparatus, typically the processor 10 illustrated in FIG. 9. The replenisher feeding system generally designated at 25 is adapted to feed a developer replenisher to the developing tank 14 and a fixer replenisher to the fixing tank 16. In this embodiment, the developer replenisher to the developer tank 14 is prepared by mixing three partial stocks (or three divided stock liquids for developer replenishment) with water, and the fixer replenisher to the fixer tank 16 is prepared by mixing a fixer replenishing stock with water.

Figure 11:
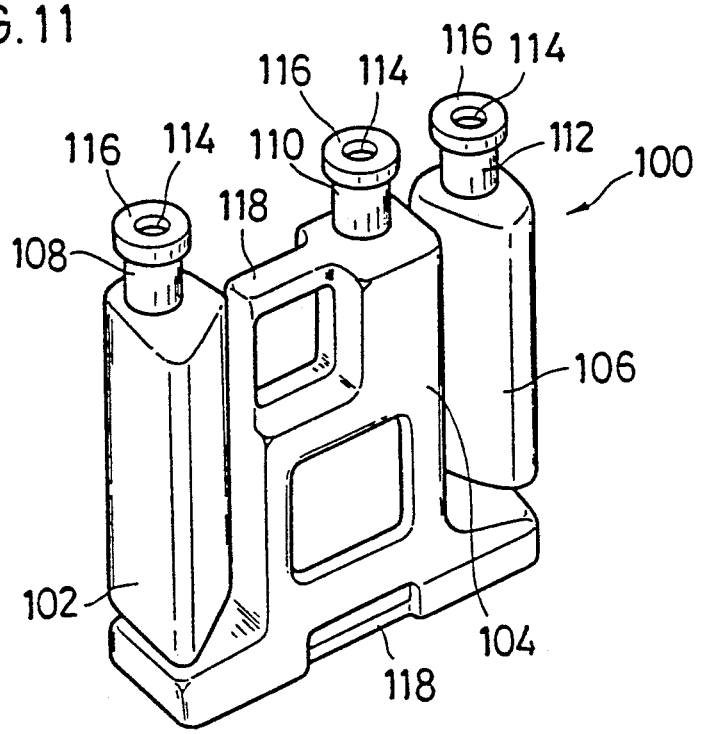
FIG. 11 is a perspective view of a cartridge for receiving partial stocks of the developer replenisher therein.

The developer replenishing liquid stock is previously charged in a cartridge or container 100 in a sealed manner as shown in FIG. 11. More particularly, the cartridge 100 has three discrete compartments 102, 104, and 106 defined in its interior by partition walls. Each compartment is a reservoir for receiving a developer replenishing stock part or partial stock. That is, the first compartment 102 is filled with partial stock A, second compartment 104 filled with partial stock B, and third compartment 106 filled with partial stock C. The cartridge 100 includes outlet ports 108, 110 and 112 in communication with the first, second and third compartments 102, 104 and 106, respectively. The outlet ports 108, 110 and 112 of generally cylindrical configuration extend parallel in the same direction and terminates at a common plane. The open ends of outlet ports 108, 110 and 112 are covered with sealing diaphragms 114 which are held in place by annular caps 116 threadably mounted on the outlet ports 108, 110 and 112 so that the sealing diaphragms 114 close the open ends of outlet ports 108, 110 and 112. A central portion of the sealing diaphragm on the outside is exposed through the opening of the cap. The cartridge 100 is provided with grips 118 on the side of outlet ports 108, 110 and 112 and on the opposite side, with which the cartridge can be manually handled.

Figure 12:
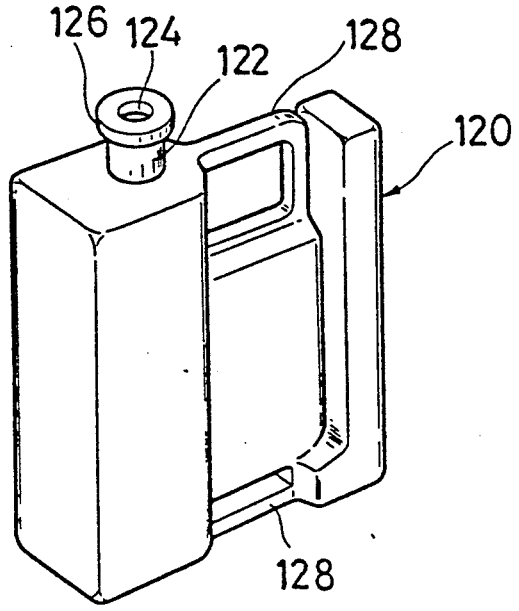
FIG. 12 is a perspective view of a cartridge for receiving a fixer replenisher stock therein.

The fixer replenishing liquid stock is previously charged in a cartridge or container 120 in a sealed manner as shown in FIG. 12. The cartridge 120 defines a single chamber filled with the fixer replenishing stock and includes an outlet port 122 of generally cylindrical configuration. The open end of outlet port 122 is covered with a sealing diaphragm 124 which is held in place by an annular cap 126 threadably mounted on the outlet port 122 so that the sealing diaphragm 124 closes the open end of outlet port 122. Also the cartridge 120 is provided with grips 128 on the side of outlet port 122 and on the opposite side, with which the cartridge can be manually handled.

The replenisher feeding system 25 includes a supply section 130 for accommodating the cartridges 100 and 120 and supplying the developer partial stocks and fixer stock in the cartridges 100 and 120 to a storage tank 50 which will be described later. The supply section 130 is shown at the left of FIG. 10 and described in detail by referring to FIGS. 13 to 16.

Figure 15:
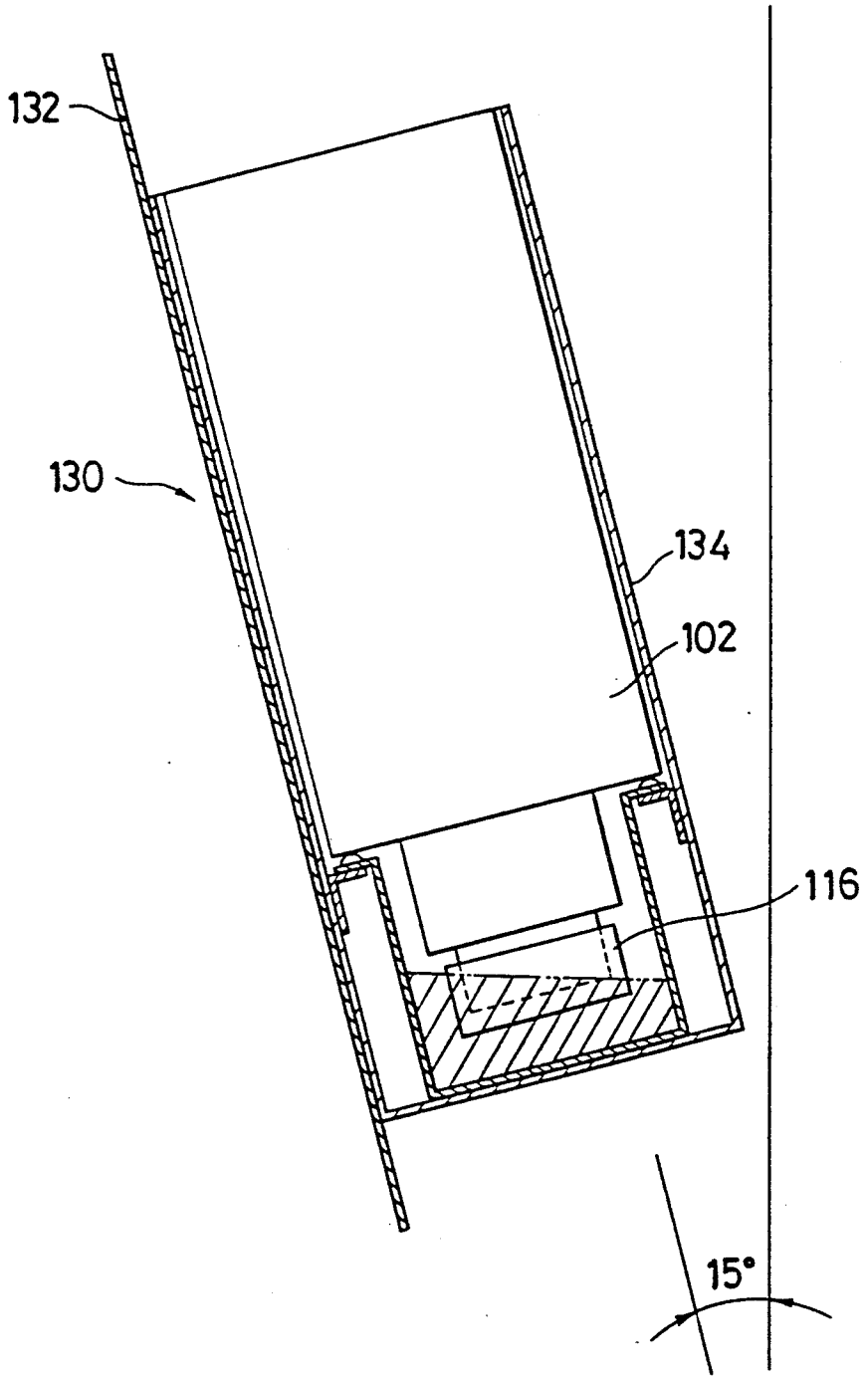
FIG. 15 is a side view of the cartridge receptacle in an inclined state.

The supply section 130 is located on one side of the processor frame 12 in a transverse direction of film F being transferred through the processor 10. In this embodiment, the supply section 130 is on a side of the processor frame 12 facing the viewer in FIG. 9. The supply section 130 includes an exterior lid member 132 defining part of the side wall of the processor 10 and a receptacle 134 secured to the inside of the exterior lid member 132 for accommodating the cartridges therein. The receptacle 134 is of a box configuration open at the top as best shown in FIG. 15 and of the size to accommodate both the cartridges 100 and 120 therein.

Figure 14:
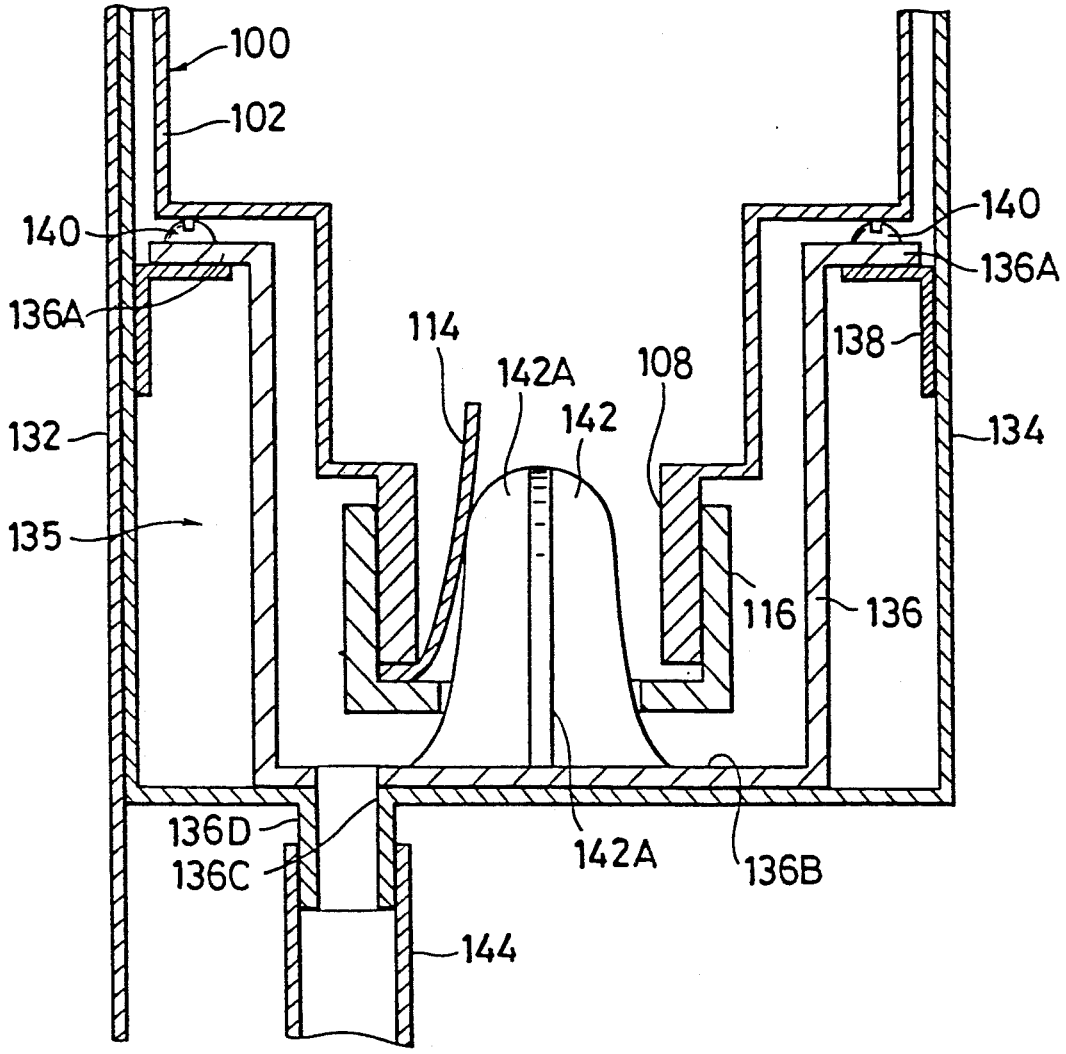
FIG. 14 is a cross-sectional view of the mating means for receiving the cartridge outlet port and perforating the seal thereof.

The cartridge receptacle 134 at the bottom is provided with a plurality of, four in this embodiment, mating means 135 which correspond to the outlet ports 108, 110, 112 and 122 of the cartridges 100 and 120 as shown in FIG. 14. Since these mating means 135 are of substantially the same configuration, one mating means 135 corresponding to the first compartment 102 filled with partial stock A of the cartridge 100 is described as a representative.

Figure 14A:
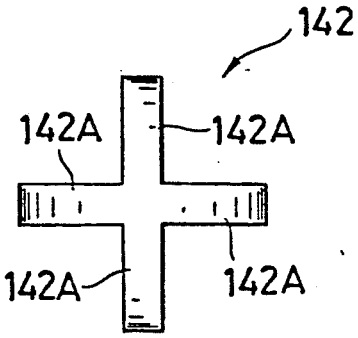
FIG. 14A is a transverse cross-sectional view of the unsealing means.

As shown in FIG. 14, the mating means 135 includes a liquid reservoir 136 of an inverted hat shape. The reservoir 136 is placed in the receptacle 134 with its bottom 136B in abutment with the receptacle bottom. The reservoir 136 at the top has a circumferential flange 136A secured by screws 140 to a circumferential bracket 138 which is, in turn, secured to the side wall of the cartridge receptacle 134. A projection 142 is located at the center of the reservoir bottom 136B. The projection 142 consists of four plate segments 142A assembled in substantially crisscross in a horizontal cross section as seen from the top view of FIG. 14A. The plate segments 142 each are divergent from the top to the bottom with their top portions being rounded into a continuous arcuate shape. The projection 142 may be formed from a single member to the same or similar shape. The projection 142 may be secured to the receptacle bottom 136B or simply placed thereon.

The mating means 135 further includes a connecting port 136D in the receptacle bottom 136B spaced away from the projection 142 on the receptacle bottom 136B. The connecting port 136D defines a flow path 136 inside and extends downward through the receptacle bottom 136B. To the connecting port 136D is connected a flexible tube 144 whose other end terminates in the storage tank 50.

When the cartridge 100 is mounted in the receptacle 134, the projection 142 engages the sealing diaphragm 114 in the cap 116 on the outlet port 108 of the first compartment 102 to break or move upward the sealing diaphragm 114 as shown in FIG. 14, allowing the partial stock A in the cartridge compartment 102 to flow in the reservoir 136 space and then to the storage tank 50 through the flow path 136C of the connecting port 136D and tube 144. Although the sealing diaphragm 114 is displaced into the outlet port 108 by the projection 142 in the illustrated embodiment, a cutting edge or any other seal breaking means may be used instead of the projection 142 insofar as the outlet port of the cartridge compartment is unsealed for fluid communication.

With the seal broken, the liquid partial stock A spills into the reservoir 136 through the gap between the projection 142 and the cap 116. The cartridge receptacle 134 is placed at substantially the same height as the storage tank 50 such that the spillage of liquid partial stock A into the reservoir 136 may stop when the liquid surface reaches a predetermined level. Since the mating means 135 are provided in conjunction with the outlet ports 108, 110, 112 and 122 of the cartridges 100 and 120 as previously described, the developer partial stocks A, B and C and the fixer stock are supplied to the storage tank 50 as soon as the cartridges 100 and 120 are mounted in the receptacle 134.

Figure 13:
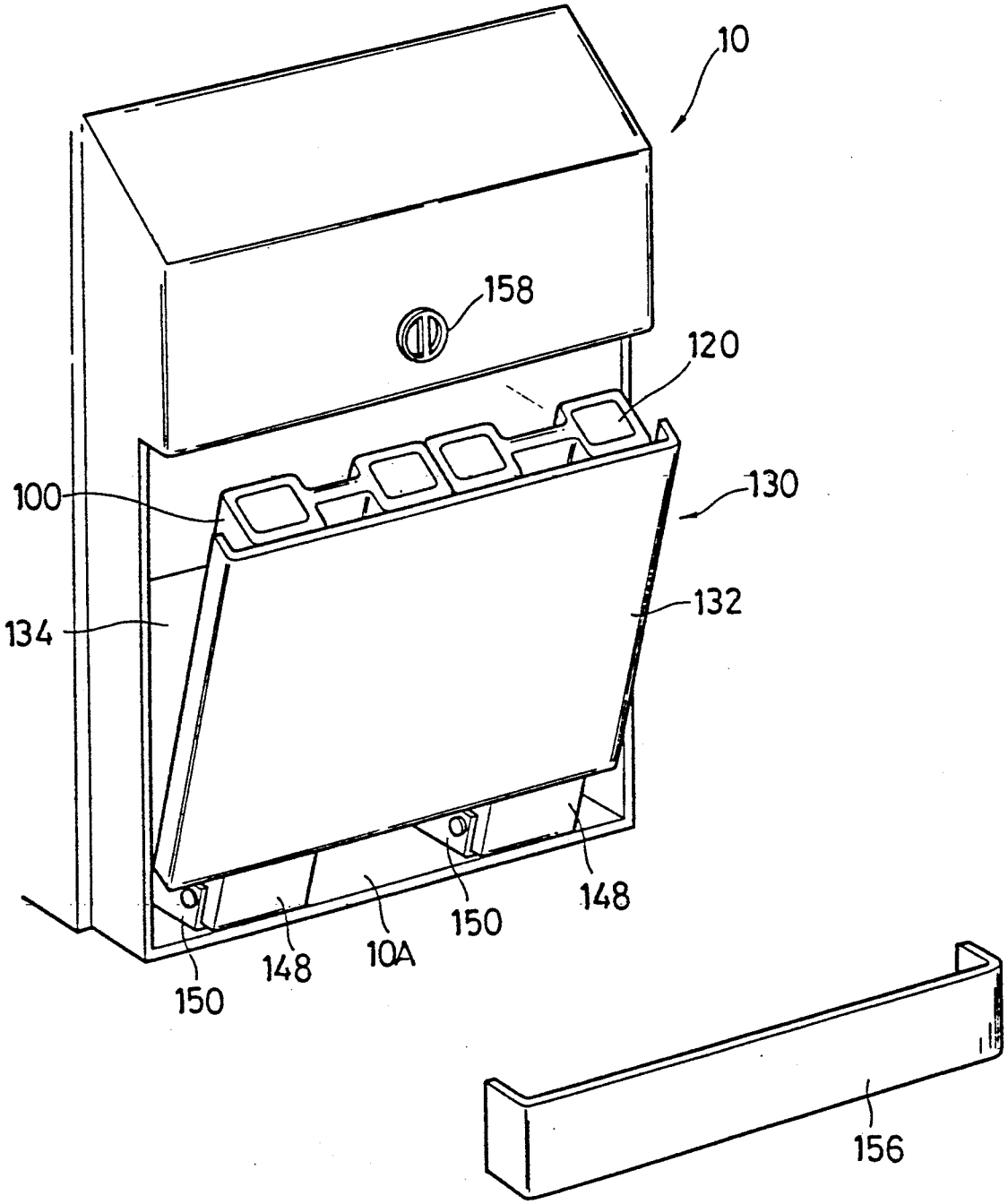
FIG. 13 is a perspective view of a supply section.
Figure 16:
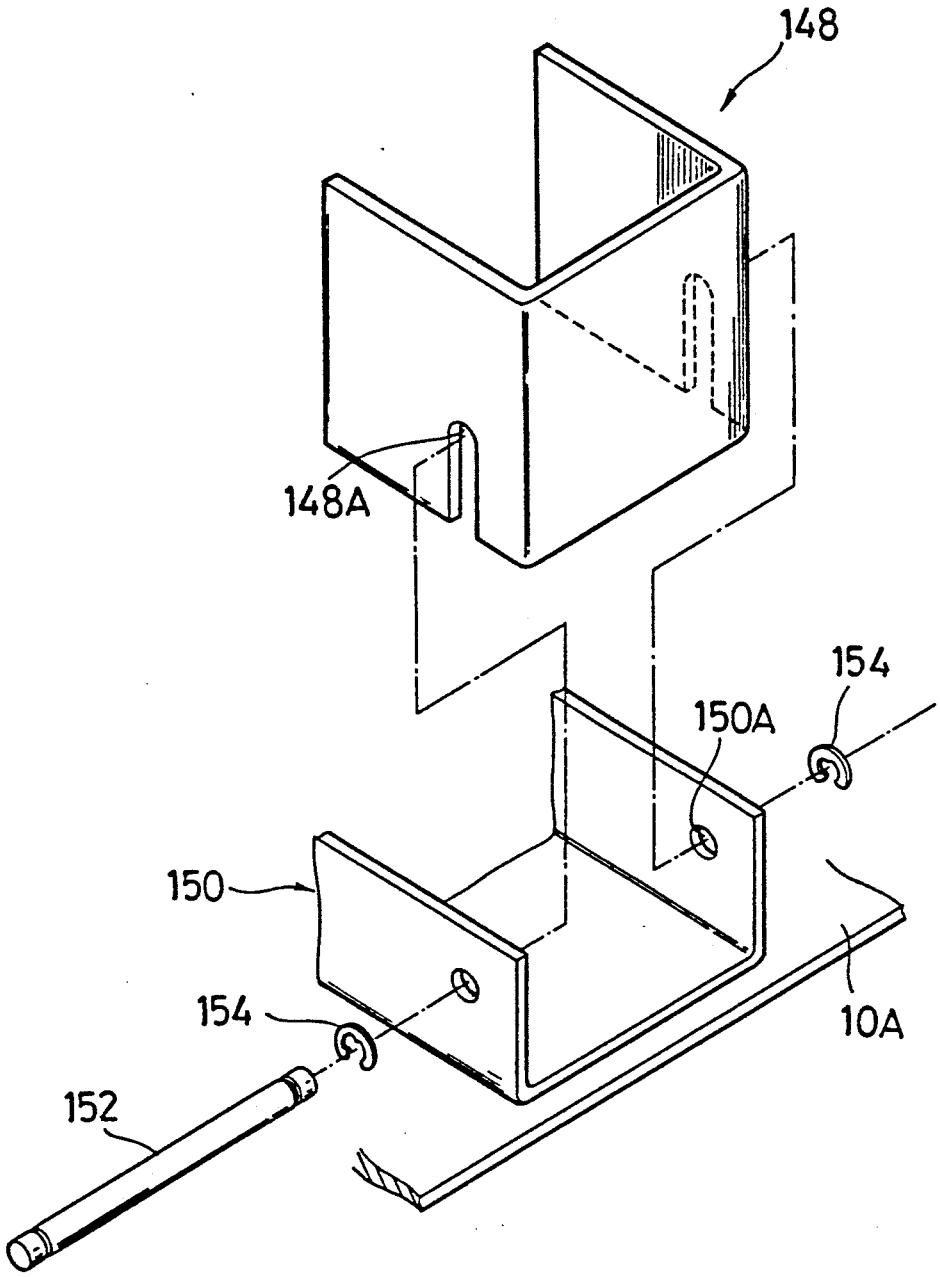
FIG. 16 is an exploded perspective view of the means for pivotally mounting the cartridge receptacle.

The supply section 130 of the above-mentioned construction is pivotally supported at the lower end of the exterior lid member 132. More particularly, a pair of legs 148 extend downward from the lower edge of the exterior lid member 132 as shown in FIG. 13. Each leg 148, as shown in FIG. 16, is a generally U shaped member having opposed walls in which slots 148A extending upward from the lower edge are formed in alignment. In turn, on the frame side of the processor 10, supports 150 are fixedly secured to a bottom plate 10A of the frame for supporting the legs 148 as shown in FIG. 13. More particularly, each support 150 is an upward facing generally U shaped member having opposed walls in which through holes 150A are formed in alignment. A pivot member 152 is inserted through the holes 150A and axially secured to the support 150 by E rings 154 mounted on the pivot member 152 adjacent the holes 150A. The leg 148 is fitted within the opposed walls of the support 150 such that the pivot member 152 engages the slots 148 in the leg 148. With this structure, the supply section 130 is installed for pivotal motion about the pivot 152 between open and closed positions. The pivotal mount is not limited to the illustrated embodiment. For example, the supply section 130 may be installed by inserting a length of bolt through the holes 150A, engaging a nut to the tip of the bolt, and mounting the receptacle 134 such that the bolt engages the slots 148A in the leg 148 walls.

Referring to FIG. 13 again, the processor 10 includes a retainer means 158 located above the supply section 130 for of the supply section 130 in the closed position by engaging with a tab (not shown) inside the exterior lid 132 of the supply section 130. It is to be noted that the supply section 130 is illustrated in the open position in FIG. 13. The locking engagement of the retainer means 158 with the exterior lid 132 tab is released by rotating the retainer means 158 a predetermined angle. The cartridge receptacle 134 of the supply section 130 is attached to the interior frame of the processor through a gas damper (not shown). The gas damper not only allows for smooth pivotal motion of the supply section 130 between the closed position where the cartridges 100 and 120 are accommodated in place and the open position where the cartridges 100 and 120 can be installed or withdrawn, but also limit the pivotal motion of the supply section 130 within a predetermined angular range. In one preferred embodiment, the gas damper is set so as to limit the pivotal motion of the supply section 130 to the range of 15 degrees from the closed or vertical position as shown in FIG. 15.

Further, a cover 156 is fitted in the processor frame below the supply section 130 as shown in FIG. 13 such that the cover 156 covers the legs 148 and supports 150 for aesthetic appearance.

The automatic processor 10, at the rear side of the frame opposite to the side where the supply section 130 is installed, is further provided with a similar pivotal mount structure which is covered with a removable cover, though the rear pivotal mount structure is not shown. The rear pivotal mount structure includes supports similar to the supports 150 on the processor bottom plate 10A. Then, the supply section 130 can be simply removed from the front side of the processor 10 by withdrawing it upward to disengage the leg slots 148A from the pivots 152 and disconnecting the gas damper if any, and then attached again to the rear side thereof by fitting in place.

Installed on the bottom plate 10A of the processor 10 is the storage tank 50. As shown in FIG. 10, the storage tank 50 includes four compartments defined by partitions. That is, the storage tank 50 includes first, second, third and fourth compartments 50A, 50B, 50C and 50D which correspond to the first, second and third compartments 102, 104 and 106 of the developer cartridge 100 and the fixer cartridge 120, respectively. Therefore, the first compartment 50A receives and stores the developer partial stock A from the first compartment 102 of the cartridge 100, the second compartment 50B receives and stores the developer partial stock B from the second compartment 104 of the cartridge 100, the third compartment 50C receives and stores the developer partial stock C from the third compartment 106 of the cartridge 100, and the fourth compartment 50D receives and stores the fixer stock from the cartridge 120.

Also installed within the processor 10 is a water supply tank 162 for receiving and storing city water as shown at the right in FIG. 10. Usually the water tank is located backward of the squeeze rack 40 to the viewer in FIG. 9.

The processor 10 further includes a first mixing tank 58 for preparing a developer replenisher prior to entry to the developing tank 14 and a second mixing tank 60 for preparing a fixer replenisher prior to entry to the fixing tank 16.

As shown in FIG. 10, feed conduits 62A, 62B and 62C having bellows pumps 64A, 64B and 64C inserted therein connect the first, second and third compartments 50A, 50B and 50C to the first mixing tank 58. A feed conduit 66A having a bellows pump 68A inserted therein connects the water tank 162 to the first mixing tank 58. When the bellows pumps 64A, 64B, 64C and 68A are actuated, the developer partial stock A in the first compartment 50A, developer partial stock B in the second compartment 50B, developer partial stock C in the third compartment 50C, and water in the water tank 162 are supplied to the first mixing tank 58 through the feed conduits 62A, 62B, 62C and 66A, respectively. The first mixing tank 58 mixes developer partial stocks A, B and C and dilutes the mixture with water at the same time to prepare a developer replenisher to be fed to the developing tank 14.

Similarly, a feed conduit 62D having a bellows pump 64D inserted therein connects the fourth compartment 50D to the second mixing tank 60. A feed conduit 66B having a bellows pump 68B inserted therein connects the water tank 162 to the second mixing tank 60. When the bellows pumps 64D and 68D are actuated, the fixer stock in the fourth compartment 50D and water in the water tank 162 are supplied to the second mixing tank 60 through the feed conduits 62D and 66B, respectively. The second mixing tank 60 dilutes the fixer stock with water to prepare a fixer replenisher to be fed to the fixing tank 16.

A conduit 71 having a circulating pump 72 inserted therein is connected at either end to the developing tank 14 for circulating the developer liquid through the tank. A feed conduit 70 at one end is connected to the first mixing tank 58 and the other end of feed conduit 70 connected to the conduit 71 upstream of the pump 72. With the operation of the circulating pump 72, the developer replenisher formed in the first mixing tank 58 is fed to the developing tank 14 through the conduits 70 and 71 while it is mixed with part of the developer circulating through the conduit 71, accomplishing addition of the replenisher to the developer.

A conduit 75 having a circulating pump 76 inserted therein is connected at either end to the fixing tank 16 for circulating the fixer liquid through the tank. A feed conduit 74 at one end is connected to the second mixing tank 60 and the other end of feed conduit 74 connected to the conduit 75 upstream of the pump 76. With the operation of the circulating pump 76, the fixer replenisher formed in the second mixing tank 60 is fed to the fixing tank 16 through the conduits 74 and 75 while it is mixed with part of the fixer circulating through the conduit 75, accomplishing addition of the replenisher to the fixer.

Figure 19:
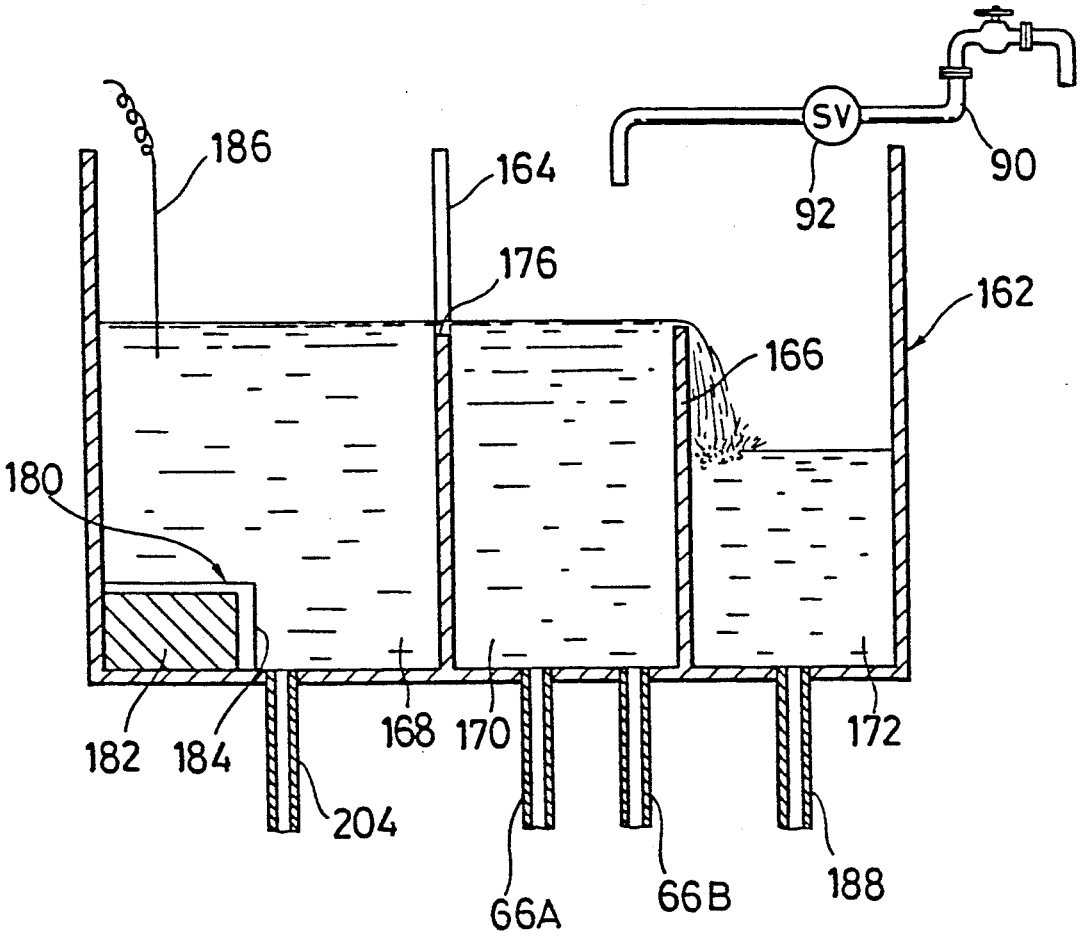
FIG. 19 is a cross-sectional view of the water storage tank in the arrangement of FIG. 10.
Figure 19A:
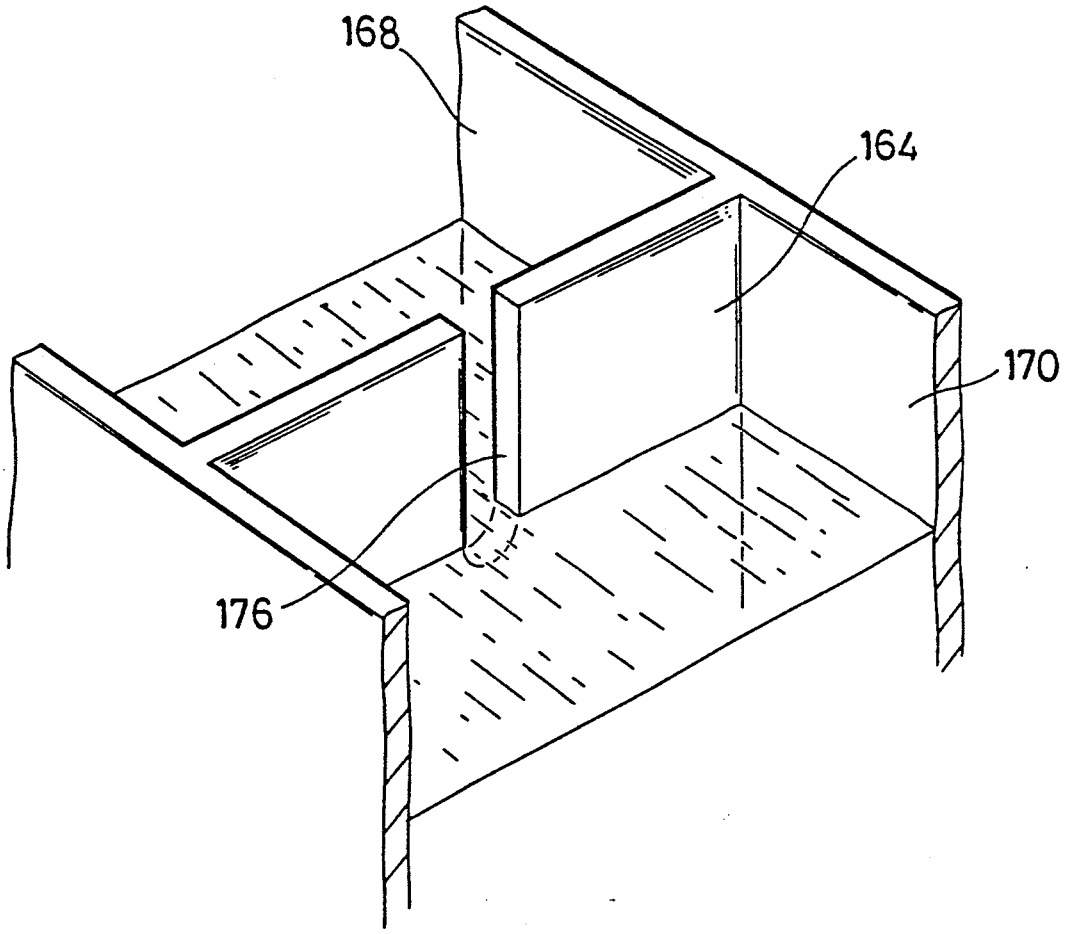
FIG. 19A is a fragmental perspective view of a partition in the water storage tank of FIG. 19.

As previously described, the water supply tank 162 for receiving and storing city water shown at the right in FIG. 10 is located backward of the squeeze rack 40 to the viewer in FIG. 9. The detail of water supply tank 162 is shown in FIG. 19. The water tank 162 includes a rectangular housing the interior of which is divided into first, second and third compartments 170, 168 and 172 by partitions 164 and 66. The first compartment 170 receives city water through a conduit 90 which is connected to a tap via a solenoid valve 92. The partition 166 is lower than the peripheral wall of the tank 162 so that the water supplied to the first compartment 170 will flow over the partition 166 into the third compartment 172. The partition 164 is approximately as high as the peripheral wall of the tank 162. The partition 164 is formed with a slot 176 as shown in FIG. 19A which extends downward from the top edge and terminates at a position slightly lower than the top edge of the partition 66, so that the first and second compartments 170 and 168 are in flow communication through the slot 176. A plurality of slots may be formed if desired. Then, the water supplied to the first compartment 170 not only flows down into the third compartment 172, but is also distributed to the second compartment 168 through the slot 176. The means for communicating the first compartment 170 to the second compartment 168 is not limited to the slot 176 and any desired communication structures such as a horizontal slot near the water surface may be utilized.

Means 180 for releasing silver ions to control the growth of algae is disposed at the bottom of the second compartment 168. The means 180 includes a source for releasing silver ions 182 and a water permeable container 184 having the source received therein. The silver ion releasing source 182 may be a water leachable glass containing monovalent Ag. The water leachable glass is comprised of at least one network forming oxide selected from $SiO_2$, $B_2O_3$ and $P_2O_5$, at least one network modifying oxide selected from $Na_2O$, $K_2O$, CaO, MgO, BaO and ZnO, and at least one intermediate oxide selected from $Al_2O_3$ and $TiO_2$ and contains 0.05 to 10% by weight, preferably 0.1 to 5% by weight of $Ag_2O$. The amorphous water-soluble glass becomes gel in water, retains a given amount of silver cations in the gel, and gradually releases silver cations into water. The glass may be in a mass, granular or powder form. It is received in a water-permeable container (e.g., a nonwoven fabric bag) which is placed in water. A mass of water-leachable glass may be used by receiving it in a mesh bag and suspending the bag in water with a string. The water-leachable glass is used in an amount of 1,000 to 100,000 grams per cubic meter of the volume of the second wash water compartment 168. Such a water-leachable glass is commercially available as Biosure SG from Kinki Pipe Giken K. K. of Japan.

Any other silver cation sustained release sources may be used as long as they allow $Ag^+$ to be dissolved out in trace increments in exchange with $H^+$ in water. For example, Stain Killer commercially available from Keiyo K. K. may be used. Another example of the silver cation release means 180 is means for electrically releasing silver cations in water on the basis of the Electro-Katadyn process. This is embodied by a pair of electrodes of silver or silver-copper alloy immersed in water. Conduction of electricity across the electrodes causes a trace amount of $Ag^+$ ions to be dissolved away. One commercially available controller is Caribbean Clear Swimming Pool Purifier marketed from Caribbean Clear International of Columbia, S.C., U.S.A.

The silver cation release means is preferably controlled such that when immersed in or contacted with about 10 liters of static water at room temperature, it will release $Ag^+$ in a concentration of about 1 to 10,000 ppb, especially about 30 to 1,000 ppb after 24 hours.

The detail of the silver cation release means is described in U.S. Ser. No. 506,635 filed Apr. 9, 1990 and EPA 90106822.1 filed Apr. 10, 1990.

Figure 17:
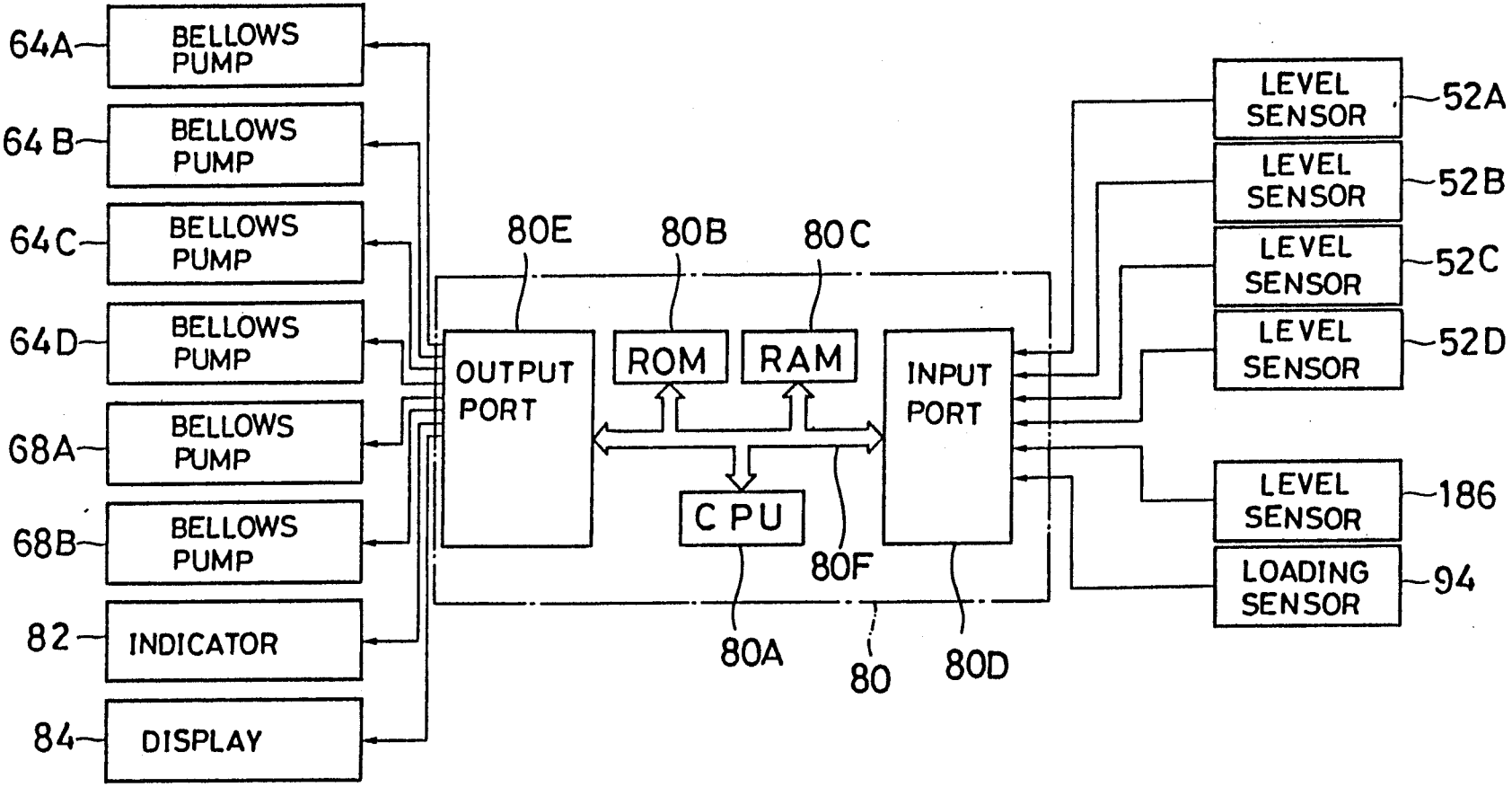
FIG. 17 is a block diagram of a system for controlling the replenisher feeding system.
Figure 18:
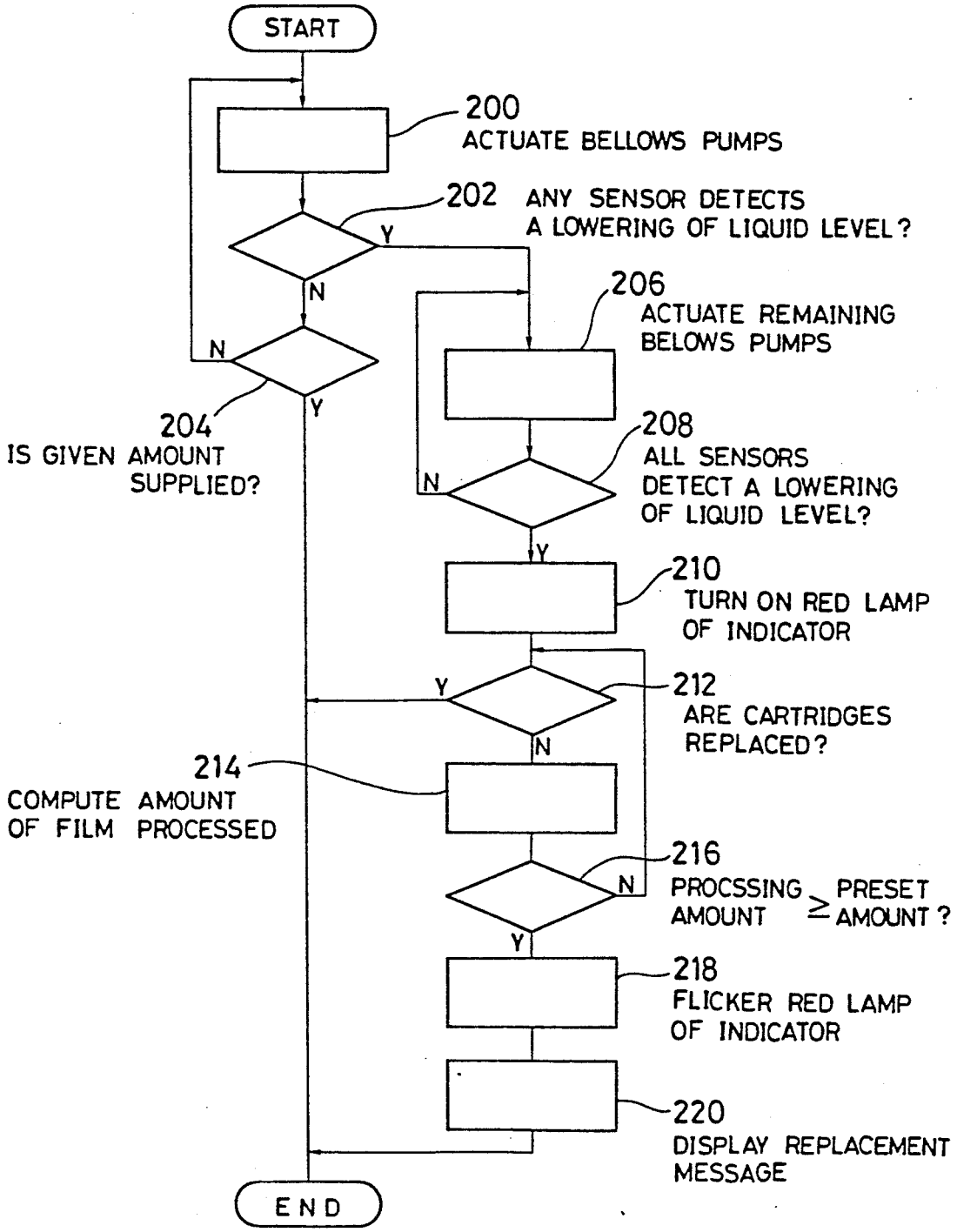
FIG. 18 is a flow diagram showing the operation of the control system of FIG. 17.

Next, the control system will be described. As shown in FIG. 10, the compartments 50A, 50B, 50C and 50D of the storage tank 50 are provided on a side wall upper portion with level sensors 52A, 52B, 52C and 52D for detecting the surface of the respective replenisher stock liquids. These level sensors 52 are connected to an input port 80D of a control means 80 as shown in FIG. 17 for delivering the detected signals regarding the surface of the respective replenisher stock liquids to the control means 80. The control means 80 includes a CPU 80A, a ROM 80B, a RAM 80C, an input port 80D and an output port 80E linked through a data bus 80F. The control means 80 is designed so as to judge that when the liquid level detected by a respective one of the sensors 52 is below a predetermined value, a corresponding one of the compartments of the developer cartridge 100 and the fixer cartridge 120 is emptied of the developer partial stock or fixer stock. The bellows pumps 64A to 64D in the feed conduits 62A to 62D connected to the compartments 50A to 50D are coupled to the output port 80E of the control means 80 such that the control means controls the operation of the bellows pumps.

As shown in FIGS. 10 and 19, the water tank 162 is provided on a side wall upper portion with a level sensor 186 for detecting the surface of water. This level sensor 186 is coupled to the input port 80D of the control means 80 as shown in FIG. 17 for delivering the detected signal regarding the surface of water to the control means 80. The control means 80 judges the necessity of making up city water when the water level detected by the sensor 186 is below a predetermined value. The bellows pumps 68A and 68B in the feed conduits 66A and 66B connected between the water tank 162 and the mixing tanks 58 and 60 are coupled to the output port 80E of the control means 80 which controls the operation of the bellows pumps so as to supply predetermined amounts of water to the mixing tanks 58 and 60.

The sensor 94 located at the entrance 15 of the processor 10 for detecting the entry of film F (FIG. 9) is also coupled to the input port 80D of the control means 80 as shown in FIG. 17. Based on the detection result of the loading sensor 94, the control means 80 computes the amount of film F processed, that is, the cumulative surface area of film processed and actuates the bellows pumps 64A to 64D and 68A and 68B to supply the developer and fixer replenishers to the corresponding tanks.

Further coupled to the output port 80E of the control means 80 are an indicator means 82 and a liquid crystal display 84. The indicator lamp 82 for indicating replacement provides three types of lighting using a green light and a red light which can be operated or flickered. The control means 80 controls the replacement indicating lamp 82 so as to turn on the green light during normal supply of replenishers, turn on the red light to indicate the replacement of the cartridges 100 and 120 to the operator, and flicker the red light to alarm the urgent replacement of the cartridges 100 and 120 to the operator. The control means 80 also has the liquid crystal display 84 represent a message to the operator.

The operation of the apparatus of the above-mentioned organization will be described.

An imagewise exposed film F is first loaded into the processor 10 through entrance slit 15, passed through developing, fixing and washing tanks 14, 16 and 18 where it is subject to processing with the developer, fixer and wash water, and then fed to squeezer section 40 where it is squeezed of water. The processed film F is then dried in drying section 20 with hot air and heated transfer rollers 44 and finally delivered to receptacle 49 through reverse roller 48. The processor 10 is successively loaded with sheets of film F which are processed as above and accommodated in receptacle 49.

As processing continues, the developer in developing tank 14 is gradually exhausted. Therefore, it is necessary to make up a predetermined amount of developer replenisher from mixing tank 58 to developing tank 14 at predetermined intervals or in accordance with a predetermined amount of film processed. Replenishment is conducted by actuating circulation pump 72 whereby the developer replenisher is mixed with part of the developer in developing tank 14 before entry into the tank. This minimizes a variation in the distribution of the developer components in developing tank 14 at the time, of replenishment.

As processing continues, the fixer in fixing tank 16 is also gradually exhausted. Therefore, it is necessary to make up a predetermined amount of fixer replenisher from mixing tank 60 to fixing tank 16 at predetermined intervals or in accordance with a predetermined amount of film processed. Replenishment is conducted by actuating circulation pump 76 whereby the fixer replenisher is mixed with part of the fixer in fixing tank 16 before entry into the tank. This minimizes a variation in the distribution of the fixer components in fixing tank 16 at the time of replenishment.

It is replenisher feed system 25 associated with photosensitive material processing apparatus 10 that carries out supply of replenisher stocks to mixing tanks 58 and 60. The operation of system 25 for feeding replenisher stocks is now described by following the flow diagram of FIG. 18. The control means of system 25 is programmed such that the volume of the developer and fixer replenishers in mixing tanks 58 and 60 are monitored, the algorithm in the flow diagram is executed when each liquid volume is lowered below a predetermined level, and a predetermined amount of developer replenisher stocks or fixer replenisher stock is supplied to the corresponding mixing tank.

The cartridges 100 and 120 are installed in receptacle 134 of supply section 130 until their outlet ports 108, 110, 112 and 122 fit with mating means 135 to open the seals. Then the replenisher stocks are supplied from the cartridge compartments to compartments 50A–50D of storage tank 50 in a chicken hopper manner. The surface of the replenisher stocks in storage tank compartments 50A–50D are detected by sensors 52A–52D and the detected signals delivered to control means 80. Then control means 80 causes indicator lamp 82 to turn on the green light and display 84 to represent the message "Film Developable".

Step 200 is to actuate bellows pumps 64A, 64B, 64C and 64D to thereby supply a predetermined amount of developer partial stocks A, B and C from storage tank compartments 50A, 50B and 50C to first mixing tank 58 and a predetermined amount of fixer stock from storage tank compartment 50D to second mixing tank 60. As the volume of liquid stocks in compartments 50A, 50B, 50C and 50D decreases, the balance between the atmospheric pressure and the weight of the liquid stocks in the respective compartments is lost, causing the liquid stocks in cartridges 100 and 120 to drain out to the reservoirs 136 and flow to compartments 50A, 50B, 50C and 50D until the surface of liquid stocks in compartments 50A, 50B, 50C and 50D are restored to the preset level. Such continuous supply is repeated to keep storage tank compartments 50A, 50B and 50C full of developer replenisher partial stocks A, B and C from cartridge 100 and the storage tank compartment 50D full of fixer replenisher stock from cartridge 120 at all times.

Step 202 is to judge whether or not any one of the liquid levels detected by sensors 52A, 52B, 52C and 52D is below the predetermined value. If all the liquid levels are above the predetermined values, the algorithm shifts to step 204 to judge whether or not the given amounts of replenisher stocks have been supplied. If the given amounts of replenisher stocks have not been supplied, the judgment of step 204 is denied (NO). Then steps 200 and 204 are repeated until the given amounts of replenisher stocks have been supplied. The replenishing procedure comes to an end when the given amounts of replenisher stocks have been supplied.

The bellows pumps 64A to 64D which are actuated upon replenishment tend to pump variable amounts of liquid stocks to mixing tanks 58 and 60 because the bellows are molded to the desired configuration with tolerances and some other reasons. Although the cartridge volume is designed such that developer partial stocks A, B and C in compartments 102, 104 and 106 of cartridge 100 and fixer stock in cartridge 120 are consumed in proportional amounts and become empty at the same time, there is a likelihood that the amount of a certain stock consumed vary from the remaining ones. One possible situation is that although developer partial stock A is fully consumed and cartridge first compartment 102 becomes empty, some amount of developer partial stocks B and C and fixer stock still remain in cartridges 100 and 120. In this situation, only the liquid level detected by sensor 52A is below the predetermined value. Then the judgment of step 202 becomes affirmative (YES), leading to replenishment of replenisher stocks or replacement of the cartridges in the following procedure.

Step 206 is to actuate the bellows pumps other than that bellows pump corresponding to the line where a lowering of the liquid level is detected. In the assumed situation that a lowering of the liquid level of developer partial stock A is detected, the remaining bellows pumps 52B, 52C and 52D corresponding to developer partial stocks B and C and the fixer stock are actuated. Step 208 is to judge whether or not all the liquid levels detected by sensors 52A, 52B, 52C and 52D are below the predetermined values. If any one of the liquid levels is above the predetermined value, steps 206 and 208 are repeated until all the liquid levels detected by sensors 52A, 52B, 52C and 52D become below the predetermined values. It is, however, desired to supply the residual replenisher stocks such that the developer replenisher in mixing tank 58 and the fixer replenisher in mixing tank 60 do not deviate from their acceptable range.

The algorithm shifts to step 210 in response to the affirmative judgment of step 208. Since the situation where all the liquid levels detected by the sensors become below the predetermined values means that no replenisher stocks remain in cartridges 100 and 120, step 210 acts on indicator lamp 82 to light the red lamp for indicating to the operator the necessity of replacement of the cartridges. Thus the operator will readily notice the necessity of cartridge replacement. Since all of developer partial stocks A, B and C in cartridge 100 and the fixer stock in cartridge 120 are fully consumed at this point, that is, the cartridges are empty, the operator can remove them without potential contamination of the surrounding apparatus portion with residual chemical liquid. Then the operator installs a new set of cartridges with fresh replenisher stocks. This replacement operation is very easy.

Step 212 is to judge whether or not the operator has replaced cartridges 100 and 120. Replacement of the cartridges may be judged, for example, by detecting that the retainer member 158 is engaged in place. The replenishing procedure comes to an end when the judgment of step 212 is YES. If the judgment of step 212 is NO, the algorithm shifts to step 214 to compute, on the basis of a detected signal of loading sensor 94, the amount or accumulative surface area of film processed since the lighting of the red lamp of indicator means 82. Step 216 is to judge whether or not the computed amount of film processed exceeds a predetermined processing amount. The predetermined amount may be set to an amount corresponding to 200 quarter-size sheets of film. If the judgment of step 216 is NO, the algorithm goes back to step 212. Steps 212 to 216 are repeated until the cartridges are replaced or the amount of film processed exceeds the predetermined amount.

If the judgment of step 216 is YES, the algorithm shifts to a step 218 to flicker the red lamp of indicator means 82. Step 218 is also programmed to represent a message "Replace Cartridge" on display 84, providing an alarm of urgent cartridge replacement to the operator.

In the above-illustrated embodiment, when at least one of the liquid levels detected by the sensors 52A to 52D is below the predetermined value, the remaining cartridge compartments are forcedly emptied of the respective replenisher stocks so that the remaining liquid levels are also below the predetermined values and thereafter, the indicator lamp 82 is lighted. With the red lamp on, the operator will readily notice the necessity of cartridge replacement.

The means 82 for indicating the replacement of cartridges is described as a set of lamps in the illustrated embodiment although any desired indicators with which the operator will notice the necessity of replacement may be used, for example, a buzzer.

Also, in the above-illustrated embodiment, the residual liquid replenisher stocks in the cartridges are forcedly drained to the mixing tanks by actuating the bellows pumps although the present invention is not limited thereto. For example, exhaust conduits having valves mounted therein are connected to compartments 50A to 50D of storage tank 50 so that the residual liquid replenisher stocks in the cartridges and the storage tank compartments may be drained and discarded.

Figure 20:
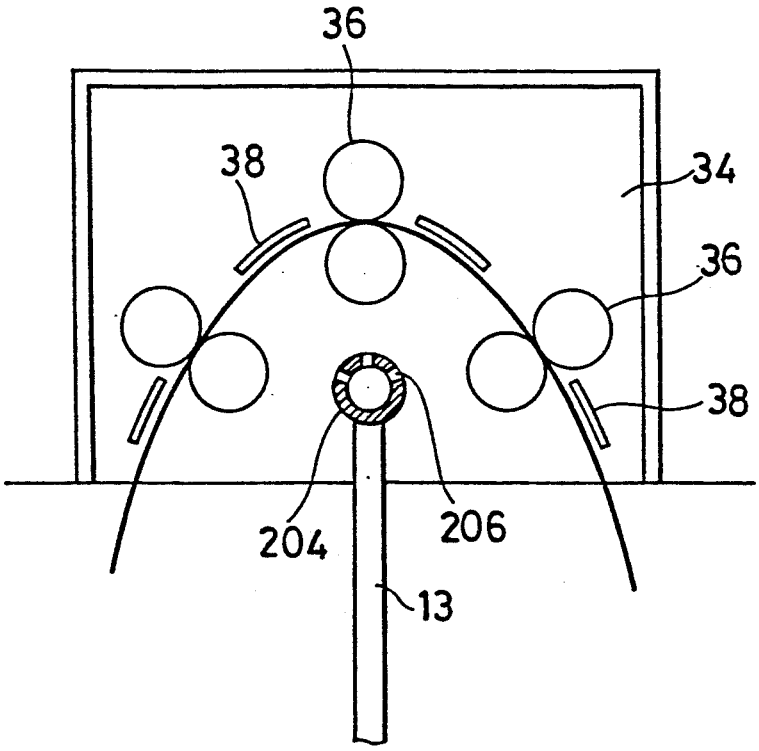
FIG. 20 is a cross-sectional view of a crossover rack and a water sparger associated therewith.

The system further includes a line for washing crossover racks 34 (see FIG. 9), which includes the water tank 162, a conduit 204 extending from the bottom of water tank compartment 168 (see FIG. 19) to crossover rack 34 (see FIG. 20), and a pump (not shown) in the conduit. The terminal portion of conduit 204 lies on the partition 13 and is formed with orifices 206 as shown in FIG. 20.

The crossover racks 34 are washed at the end of operation of automatic processor 10, for example, at the end of daily film processing. More particularly, at the end of routine operation of processor 10, the pump is actuated to pump water from compartment 168 through conduit 204. Water is injected through orifices 206 toward crossover rack 34, particularly clamping transfer rollers 36 and guide plates 38. After a predetermined time, the pump is stopped, ceasing to wash crossover racks 34.

Some water remains in conduit 204 after the pump is interrupted. This water contains silver ions released from silver ion release means 180 which are effective in controlling the growth of bio-slime or algae. Since orifices 206 are prevented from clogging, washing of crossover racks 34 is started without disabilities at the end of subsequent (e.g., next day) operation of processor 10.

The type of photosensitive material which can be processed in the practice of the invention is not particularly limited. Any desired types of photosensitive material may be processed, including color negative film, color reversal film, color photographic paper, color positive film, color reversal photographic paper, printing photographic photosensitive material, radiographic photosensitive material, black-and-white negative film, black-and-white photographic paper, and micro-film photosensitive material. The invention is adapted for the processing of black-and-white photosensitive materials among others, especially medical and industrial radiographic photosensitive materials, duplicating photographic materials for X-ray photography and medical CRT image duplicating photographic photosensitive materials, as typified by direct and indirect radiographic films and CRT duplicating films.

The present invention can be applied to either black-and-white processing including development, fixation and washing or color processing including development, bleaching, fixation (or bleach-fixation), washing and optionally, stabilization, although best results are obtained when applied to development and fixation procedures.

The partial stocks used in the practice of the present invention are described with respect to partial stocks for black-and-white developer as a typical example.

The black-and-white developers generally include two-and three-part compositions. The two-part composition consists of an alkaline partial stock containing a developing agent, referred to as partial stock A, and a partial stock containing a hardener, especially a dialdehyde hardener, referred to as partial stock C. The three-part composition consists of a partial stock A containing a developing agent, a partial stock B containing an auxiliary developing agent, and a partial stock C containing a hardener, especially a dialdehyde hardener.

In partial stock A or B, the developing agent and auxiliary developing agent (simply referred to as developing agent, hereinafter) include dihydroxybenzene developing agents, pyrazolidone developing agents, and p-aminophenol developing agents. Partial stock A or B may additionally contain an alkaline agent, preservative, buffer agent, chelating agent, organic solvent, antifoggant and the like.

The dihydroxybenzene developing agents include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone, with the hydroquinone being preferred. The partial stock preferably contains a dihydroxybenzene in an amount of about 10 to 250 grams, more preferably about 15 to 150 grams per liter of the partial stock.

The pyrazolidone developing agents include 1-phenyl-3-pyrazolidone, 1-phenyl-4,4-dihydroxymethyl-3-pyrazolidone, 1-p-tolyl-4,4-dihydroxymethyl-3-pyrazolidone, 1-phenyl-4-hydroxymethyl-4-methyl-3-pyrazolidone, 1-phenyl-4,4-dimethyl-3-pyrazolidone, 1-phenyl-2-hydroxymethyl-4,4-dimethyl-3-pyrazolidone, 1-phenyl-2-morpholinomethyl-4,4-dimethyl-3-pyrazolidone, and 1-phenyl-2-morpholinomethyl-4-methyl-3-pyrazolidone.

The p-aminophenol developing agents include N-methyl-p-aminophenol, p-aminophenol, N-($\beta$-hydroxyethyl)-p-amino-phenol, N-(4-hydroxyphenyl)glycine, 2-methyl-p-aminophenol, and p-benzylaminophenol, with the N-methyl-p-aminophenol being preferred.

The preservatives include sodium sulfite, potassium sulfite, lithium sulfite, ammonium sulfite, sodium bisulfite, and potassium metabisulfite.

The alkaline agents or buffer agents used for pH adjustment include pH adjusting agents such as sodium hydroxide, potassium hydroxide, sodium carbonate, potassium carbonate, sodium tertiary phosphate, and potassium tertiary phosphate. Also useful are buffer agents, for example, borates as disclosed in Japanese Patent Application No. 28708/1986, saccharose, acetoxime, and 5-sulfosalicylic acid as disclosed in Japanese Patent Application Kokai (JP-A) No. 93433/1985, phosphates and carbonates.

Other additives include development inhibitors such as sodium bromide, potassium bromide and potassium iodide; organic solvents such as ethylene glycol, diethylene glycol, triethylene glycol, dimethylformamide, methyl cellosolve, hexylene glycol, ethanol, and methanol; and antifoggants, for example, mercapto compounds such as 1-phenyl-5-mercapto-tetrazole and sodium 2-mercaptobenzimidazole-5-sulfonate and benzotriazole compounds such as 5-methylbenzotriazole. If desired, any toning agents, surface active agents, defoaming agents, water softeners, and especially amino compounds as disclosed in JP-A 106244/1981 may be contained.

The dialdehyde hardeners contained in partial stock C include glutaraldehyde, $\alpha$-methylglutaraldehyde, $\beta$-methyl-glutaraldehyde, maleindialdehyde, succindialdehyde, methoxy-succindialdehyde, methylsuccindialdehyde, $\alpha$-methoxy-$\beta$-ethoxyglutaraldehyde, $\alpha$-n-butoxyglutaraldehyde, $\alpha,\alpha$-dimethoxysuccindialdehyde, $\beta$-isopropylsuccindialdehyde, $\alpha,\alpha$-diethylsuccindialdehyde, butylmaleindialdehyde, and bisulfite adducts thereof. Partial stock C preferably contains dialdehyde hardeners in an amount of about 50 to 400 grams, more preferably about 100 to 300 grams per liter of the partial stock.

Partial stocks B and C may further contain acids such as acetic acid and indazole compounds such as 5-nitroindazoles.

The fixer is usually an aqueous solution containing a thiosulfate at pH 3.8 or higher, preferably 4.2 to 7.0. The fixing agents include sodium thiosulfate and ammonium thiosulfate, with the ammonium thiosulfate being preferred for fixing rate. The amount of the fixing agent used may be suitably chosen although it usually ranges from about 0.1 to about 6 mol/l.

The fixer may contain water-soluble aluminum salts having a hardener function, for example, aluminum chloride, aluminum sulfate and potassium alum.

Also the fixer may contain tartaric acid, citric acid, gluconic acid and derivatives thereof alone or in admixture of two or more. These compounds are preferably contained in amounts of at least 0.005 mol, more preferably 0.01 to 0.03 mol per liter of the fixer.

If desired, the fixer may contain preservatives (e.g., sulfites and bisulfites), pH buffer agents (e.g., acetic acid and boric acid), chelating agents capable of softening hard water, and compounds capable of promoting dissolution of sensitizing dyes as disclosed in JP-A Nos. 4739/1989 and 15734/1989 and Japanese Patent Application Nos. 17776/1988, 256807/1988, 114458/1989 and 136579/1989.

The fixers generally include two- and one-part compositions. In order to increase the film hardening power of the fixer, the fixer composition is often divided into two parts, that is, a hardener part containing an acidic hardener, typically a water-soluble aluminum salt, referred to as partial stock B, and another part containing the fixer components other than the hardener part components, referred to as partial stock A. If desired, the hardener may be contained in partial stock A, which results in a one-part composition. In this case, the composition should preferably be adjusted to pH 4.5 or higher in order to improve the stability of thiosulfate ions, known as sulfide life.

For both the developer and fixer, the volume ratio of partial stocks should preferably be up to 15, especially up to 10.

The terms "developing time" and "fixing time" used in this disclosure mean the time from the dipping of photosensitive material in a developer bath in an automatic processor to the subsequent dipping in a fixer bath and the time from the dipping of photosensitive material in the fixer bath to the subsequent dipping in a wash or stabilizing bath, respectively. The term "wash time" is the time during which the photosensitive material is dipped in wash water. The term "drying time" is the time during which the photosensitive material is passed through the drying section in the processor, through which generally hot air at a temperature of about 35° to 100° C., preferably 40° to 80° C. is blown.

The preferred set of developing temperature and time includes about 25° to 50° C. for about 6 seconds to 2 minutes, more preferably about 30° to 40° C. for about 6 to 90 seconds, most preferably about 30° to 40° C. for about 8 to 60 seconds.

The developer and fixer each are preferably replenished in amounts of about 50 to 1500 ml, more preferably about 100 to 900 ml, most preferably about 100 to 700 ml per square meter of photosensitive material, expressed in volume after dilution of partial stocks.

In general, the photosensitive material which has been exposed imagewise is developed, fixed and then washed or stabilized. The washing process may use any of well-known techniques. The washing process includes not only conventional washing processes, but also water saving washing processes and stabilizing processes. Water containing various additives well known in the art may be used as the wash water or stabilizer. Use of water having antifungal means applied thereto as the wash water or stabilizer leads to water saving as demonstrated by a replenishing amount of up to 3 liters per square meter of photosensitive material and eliminates piping operation in installing the processor.

One known method for reducing replenishing amounts is a multi-stage (e.g., two or three-stage), counter-flow system. More efficient water washing is achieved with the multi-stage, counter-flow system since the photosensitive material after fixation is processed in a gradually cleaner direction, that is, by successively contacting with processing solutions which are gradually less contaminated with the fixer. Where washing is done with a less amount of wash water, it is desired to provide a squeeze roller washing tank as disclosed in Japanese Patent Application No. 172968/1985.

Where the washing or stabilizing tank is made up with water having antifungal means applied thereto, all or part of the overflow liquid from the washing or stabilizing tank can be recycled to the preceding processing step, that is, as the processing solution having a fixing function as disclosed in JP-A 235133/1985. Then a further saving of water is achieved and the amount of waste liquid is further reduced.

The antifungal means used herein includes UV irradiation as disclosed in JP-A 263939/1985, magnetic field application as disclosed in JP-A 263940/1985, passage through ion-exchange resins to produce pure water as disclosed in JP-A 131632/1986, and addition of antifungal agents as disclosed in Japanese Patent Application Nos. 253807/1985, 295894/1985, 63030/1986, 51396/1986, and 91533/1989. Also useful are fungicidal agents, bactericidal agents, and surface active agents as disclosed in L. E. West, "Water Quality Criteria", Phto. Sci. & Eng., Vol. 9, No. 6 (1965), M. W. Beach, "Microbiological Growths in Motion-Picture Processing", SMPTE Journal, Vol. 85 (1976), R. O. Deegan, "Photo Processing Wash Water Biocides", J. Imaging Tech., Vol. 10, No. 6 (1984), JP-A 8542/1982, 58143/1982, 105145/1983, 132146/1982, 18631/1983, 97530/1982, and 157244/1982.

The wash bath may further contain microbiocides, for example, the isothiazolines described in R. T. Kreiman, J. Imaging Tech., 10, 6 (1984), the isothiazolines described in Research Disclosure, Vol. 205, Item 20526 (May 1981), the isothiazolines described in Research Disclosure, Vol. 228, Item 22845 (April 1983), and the compounds described in Japanese Patent Application No. 51396/1986. Other useful compounds are described in Horiguchi Hiroshi, "Boukin Boubai No Kagaku (Chemistry of Fungicides and Biocides)", Sankyo Publishing K. K., 1982 and Japan Fungicidal and Biocidal Associate, "Boukin Boubai Gijutu Handbook (Handbook of Fungicidal and Biocidal Technology)", Hakuhodo K. K., 1986.

The preferred set of washing or stabilizing temperature and time includes about 0° to 50° C. for about 6 seconds to 2 minutes, more preferably about 15° to 40° C. for about 6 to 60 seconds, most preferably about 15° to 40° C. for about 6 to 25 seconds.

In the embodiment illustrated in FIG. 6, the photosensitive material S which has been developed, fixed and washed is passed through squeeze rollers located in the squeezer section 124 for squeezing off the wash water and then through the dryer section 125 where it is dried. Drying is preferably done at about 40° to 100° C. The drying time varies with the ambient conditions, but usually ranges from about 5 seconds to 1 minute, preferably from about 10 to 40 seconds at about 40° to 80° C.

Quick processing can be accomplished with the above-mentioned organization since the duration of time from the instant when the leading edge of photosensitive material reaches the entrance of the processor to the instant when the same leading edge emerges out of the processor, that is, the "dry-to-dry" time is within 4 minutes, preferably within 2 minutes, more preferably within 100 seconds.

EXAMPLE

Examples of the present invention are given below by way of illustration and not by way of limitation.

EXAMPLE 1

Using the system of the construction shown in FIG. 2, a replenisher for a black-and-white developer was prepared from the following thee partial stocks.

| | |
|---|---|
| Part A | |
| Potassium hydroxide | 330 g |
| Potassium sulfite | 630 g |
| Sodium sulfite | 240 g |
| Potassium carbonate | 90 g |
| Boric acid | 45 g |
| Diethylene glycol | 180 g |
| Diethylenetriamine pentaacetate | 30 g |
| 3,3'-dithiobishydrocinnamic acid | 3 g |
| 5-methylbenzotriazole | 0.225 g |
| Hydroquinone | 450 g |
| Potassium bromide | 15 g |
| Water | totaling to 4125 ml |
| Part B | |
| Triethylene glycol | 525 g |
| Glacial acetic acid | 102.6 g |
| 5-nitroindazole | 3.75 g |
| 1-phenyl-3-pyrazolidone | 39 g |
| Water | totaling to 750 ml |
| Part C | |
| Glutaraldehyde (50 wt/wt %) | 150 g |
| Potassium metabisulfite | 150 g |
| Water | totaling to 750 ml |

Cartridge

A polyethylene container of the structure shown at 4 in FIG. 2 was used whose interior was divided into a first compartment having a volume of 4.6 liters, a second compartment having a volume of 0.9 liters, and a third compartment having a volume of 0.9 liters. The first compartment was filled with 4125 ml of part A, the second compartment was filled with 750 ml of part B, and the third compartment was filled with 750 ml of part C. The outlet ports of the compartments was closed with foam polyethylene seals held in place by polypropylene caps.

| Storage tank | Volume |
|---|---|
| Compartment for part A | 5 liters |
| Compartment for part B | 0.9 liters |
| Compartment for part C | 0.9 liters |
| Total | 6.8 liters |

Automatic Processor

A modified version of automatic processor model FPM 9000 manufactured by Fuji Photo Film Corporation was used. It had a series of processing tanks in the arrangement shown in FIG. 6. The tanks had the following volume.

| | |
|---|---|
| Developing tank | 15 liters |
| Fixing tank | 15 liters |
| Washing tank | 13 liters |

To the developing tank was added 300 ml of the following starter.

| Starter | |
|---|---|
| Glacial acetic acid | 27 g |
| Potassium bromide | 200 g |
| Water | totaling to 2000 ml |

The washing tank was filled with city water. Four bags of non-woven fabric each containing 50 grams of Biosure SG (manufactured and sold by Kinki Pipe Giken K. K.) were placed on a plastic grid spaced 15 mm above the tank bottom. Biosure SG is a leachable glass of $Na_2O/B_2O_5/SiO_2$ containing 0.5% by weight of $Ag_2O$ having an antifungal function.

Photosensitive Material (a) Preparation of emulsion

To 1 liter of water were added 5 grams of potassium bromide, 25.6 grams of gelatin, and 2.5 cc of a 5% aqueous solution of thioether $HO(CH_2)_2S(CH_2)_2S(CH_2)_2OH$. The solution was heated at 66° C. With stirring, an aqueous solution containing 8.33 grams of silver nitrate and another aqueous solution containing 5.94 grams of potassium bromide and 0.726 grams of potassium iodide were added to the solution by the double jet method. Then 2.9 grams of potassium bromide was added and thereafter, an aqueous solution of 8.33 grams of silver nitrate was added over 24 minutes. Further added was 0.1 mg of thiourea dioxide of the following structural formula:

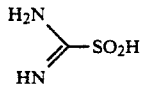

Next, 20 cc of a 25% ammonia solution and 10 cc of 50% $NH_4NO_3$ were added to the resulting solution, which was physically ripened for 20 minutes and then neutralized with 240 cc of 1N nitric acid. Subsequently, an aqueous solution of 153.34 grams of silver nitrate and an aqueous solution of potassium bromide were added over 40 minutes by the controlled double jet method while maintaining the potential at pAg 8.2. The flow rate was accelerated such that the final flow rate was 9 times the initial flow rate. At the end of addition, 15 cc of a 2N potassium thiocyanate solution was added, and then 45 cc of a 1% aqueous solution of potassium iodide was added over 30 seconds. Thereafter, the temperature was lowered to 35° C., soluble salts were removed by sedimentation, the temperature was raised to 40° C., 76 grams of gelatin, 76 mg of proxisel and 760 mg of phenoxyethanol were added, and finally, the solution was adjusted to pH 6.50 and pAg 8.20 with sodium hydroxide and potassium bromide.

The temperature was raised to 56° C., 186 mg of 4-hydroxy-6-methyl-1,3,3a,7-tetraazaindene was then added, and after 10 minutes, 520 mg of a sensitizing dye of the following structural formula was added.

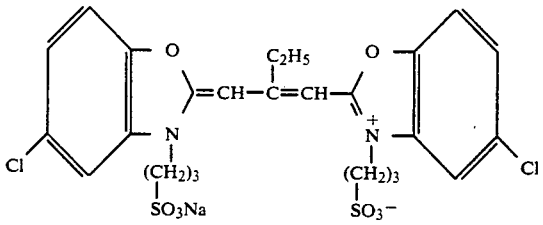

After 10 minutes, 3.4 mg of sodium thiosulfate pentahydrate, 140 mg of potassium thiocyanate, and 3.1 mg of chloroplatinic acid were added to the emulsion, which after 70 minutes, was quickly cooled down for coagulation. There was obtained an emulsion in which 99.5% of the total of projection areas of the entire grains consisted of grains having an aspect ratio of at least 3, and all of those grains having an aspect ratio of at least 2 had an average projection area diameter of 1.35 μm with a standard deviation of 22.3%, an average thickness of 0.200 μm, and an average aspect ratio of 6.8.

(b) Preparation of emulsion coating solution

A coating solution was prepared by adding the following chemical substances to the emulsion, the amount being expressed per mol of silver halide.

| | |
|---|---|
| Polymer latex poly(ethylacrylate/methacrylic acid) (97/3) | 25.0 g |
| Hardener | |
| 1,2-bis(sulfonylacetamide)ethane | 3.0 g |
| 2,6-bis(hydroxyamino)-4-diethylamino-1,3,5-triazine | 80 mg |
| Sodium polyacrylate (average molecular weight 41,000) | 4.0 g |
| Potassium polystyrenesulfonate (average molecular weight 600,000) | 1.0 g |
| Polyacrylamide (average molecular weight 45,000) | 24 g |

Preparation of support

A support was prepared by coating a blue-tinted polyethylene terephthalate base of 175 μm thick on either surface with an undercoat in the following coating weight.

| | |
|---|---|
| Gelatin | 84 mg/m² |
| 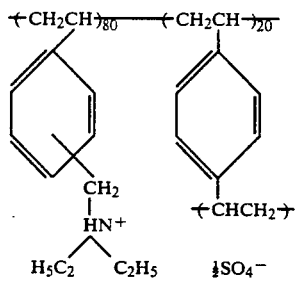 | 60 mg/m² |
| 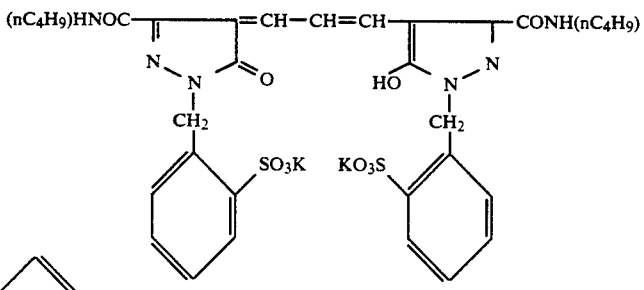 | 17 mg/m² |

Preparation of Photosensitive material

The coating solution was coated on either surface of the transparent PET support of 175 μm thick at the same time as a surface protective layer coating solution. The coating weight was 2.0 g of silver per square meter on each surface. The surface protective layer coating solution was prepared by blending the following components such that they provided the following coating weight.

| Surface protective layer | Coating weight |
|---|---|
| Gelatin | 1.15 g/m² |
| Polyacrylamide (average molecular weight 45,000) | 0.25 g/m² |
| Sodium polyacrylate (average molecular weight 400,000) | 0.02 g/m² |
| Sodium salt of p-t-octylphenoxy-diglycerylbutyl sulfonate | 0.02 g/m² |
| Polyoxyethylene cetyl ether (polymerization degree 10) | 0.035 g/m² |
| Polyoxyethylene/polyoxyglyceryl p-octylphenoxy ether (polymerization degree 10/3) | 0.01 g/m² |
| 4-hydroxy-6-methyl-1,3,3a,7-tetraazaindene | 0.0155 g/m² |
| 2-chlorohydroquinone | 0.154 g/m² |
| $C_8F_{17}SO_3K$ | 0.003 g/m² |
| $C_8F_{17}SO_2N(C_3H_7)-(CH_2CH_2O)_4-(CH_2)_4-SO_3Na$ | 0.001 g/m² |
| $C_8F_{17}SO_2N(C_3H_7)-(CH_2CH_2O)_{15}$ | 0.003 g/m² |
| Polymethyl methacrylate (average particle size 3.5 μm) | 0.025 g/m² |
| Poly(methyl methacrylate/methacrylate) (molar ratio 7:3, average particle size 2.5 μm) | 0.020 g/m² |

The thus prepared sheet photosensitive material was cut to the quarter size of 10 inches by 12 inches, imagewise exposed with X-rays, and subjected to an experiment.

Procedure

The cartridge compartments filled with parts A, B and C was unsealed by breaking the foam polyethylene seals attached to the compartment outlet ports with cutting edges on the storage tank, allowing the respective partial stocks from the cartridge in their entirety to flow down into the corresponding compartments of the storage tank. The compartments of the storage tank were equipped with level sensors for detecting the surface of the associated liquids, which were interconnected to alarm means for indicating the necessity of refilling the partial stocks.

By actuating the pumps in the form of bellows metering pumps associated with the respective feed lines, the partial stocks in the storage tank and diluent water (city water) were fed in the following proportion to the developing tank through an auxiliary tank. The replenisher was fed every 8 quarter-size sheets of photosensitive material being processed.

| Development replenisher | |
|---|---|
| Part A | 55 ml |
| Part B | 10 ml |
| Part C | 10 ml |
| Diluent water | 125 ml |
| | pH 10.50 |

Wash water was fed at a flow rate of 10 liter/minute in an amount of about 1 liter per quarter-size sheet during processing of the photosensitive material by opening an electromagnetic valve in a replenishing water line in synchronization with the entry of the photosensitive material. At the end of daily processing operation, the wash tank was emptied of the wash water in its entirety by automatically opening an electromagnetic valve associated with the discharge port of the wash tank.

Also at the end of daily processing operation, the water subject to antifungal treatment using Biosure SG as previously mentioned was automatically sprayed over rollers of the crossover racks between the developing and fixing tanks and between the fixing and washing tanks for cleaning.

COMPARATIVE EXAMPLE 1

Using the prior art system of the construction shown in FIG. 7, a replenisher for a black-and-white developer was prepared from the same three partial stocks as used in Example 1.

Containers
- A bottle filled with part A (volume 5 liters)
- A bottle filled with part B (volume 1 liter)
- A bottle filled with part C (volume 1 liter)

Storage tank
- A large sized tank having a volume of 25 liters

Automatic processor
- same as in Example 1

Photosensitive material
- same as in Example 1

Procedure

The storage tank was charged with 4125 ml of part A, 750 ml of part B, 750 ml of part C, and 9375 ml of diluent water, which were agitated and mixed to prepare a replenisher. The replenisher was fed to the developing tank in an amount of 200 ml every 8 quarter-size sheets of X-ray exposed photosensitive material being processed.

Results

Comparative Example 1 needed a large size storage tank having a volume of 25 liters to provide 15 liters of developer replenisher whereas Example 1 used a small size storage tank having a total volume of 6.8 liters to provide the same volume of developer replenisher. The storage tank of such a small size could be installed to the processor in a side-by-side relationship.

The system of Example 1 was very easy to operate since the respective partial stocks can be transferred to the storage tank compartments by a single operation. The system of Comparative Example 1 required a cumbersome, time-consuming operation to admit the partial stocks into the storage tank because the partial stocks were filled in the separate bottles.

In Example 1, no variation in composition or concentration of the developer replenisher occurred from the start to the end of replenishment.

EXAMPLE 2

The overall arrangement of the processor was the same as in Example 1. Using the system of the construction shown in FIG. 5, a replenisher for a black-and-white fixer was prepared from the following two partial stocks.

| | |
|---|---|
| Part A' | |
| Ammonium thiosulfate (70 wt/vol %) | 3 liters |
| Disodium ethylenediaminetetraacetate dihydrate | 0.45 g |
| Sodium thiosulfate pentahydrate | 150 g |
| Sodium sulfite | 375 g |
| Tartaric acid | 48 g |
| Glacial acetic acid | 472.5 g |
| Sodium hydroxide | 165 g |
| 1-(N,N-dimethylamino)ethyl-5-mercaptotetrazole | 15 g |
| Water | totaling to 4 liters |
| | pH 5.5 |
| Part B' | |
| Aluminum sulfate | 150 g |
| Sulfuric acid (36N) | 58.5 g |
| Water | totaling to 630 ml |
| | pH < 1 |

Cartridge

A polyethylene container of the structure shown at 4 in FIG. 5 was used whose interior was divided into a first compartment having a volume of 5 liters and a second compartment having a volume of 0.76 liters. The first compartment was filled with 4 l of part A' and the second compartment filled with 630 ml of part B'. The outlet ports of the compartments was sealed as in Example 1.

| Storage tank | Volume |
|---|---|
| Compartment for part A' | 4.8 liters |
| Compartment for part B' | 0.76 liters |
| Total | 5.56 liters |

Automatic processor same as in Example 1
Photosensitive material
same as in Example 1

Procedure

The cartridge compartments filled with parts A' and B' was unsealed by breaking the foam polyethylene seals attached to the compartment outlet ports with cutting edges on the storage tank, allowing the respective parts from the cartridge in their entirety to flow down into the corresponding compartments of the storage tank. By actuating the pumps in the form of bellows metering pumps associated with the respective feed lines, the parts in the storage tank and diluent water (city water) were fed in the following proportion to the fixing tank. The replenisher was fed every 8 quarter-size sheets of photosensitive material being processed.

| Fixer replenisher | |
|---|---|
| Part A' | 53.3 ml |
| Part B' | 8.4 ml |
| Diluent water | 138.3 ml |
| | pH 4.25 |

COMPARATIVE EXAMPLE 2

Using the prior art system of the construction shown in FIG. 7, a replenisher for a black-and-white fixer was prepared from the same two partial stocks as used in Example 2.
Containers
A bottle filled with part A': volume 5 liters
A bottle filled with part B': volume 1 liter
Storage tank
A large sized tank having a volume of 25 liters
Automatic processor
same as in Example 1
Photosensitive material
same as in Example 1

Procedure

The storage tank was charged with 4 l of part A', 630 ml of part B', and 10.37 l of diluent water, which were agitated and mixed to prepare a replenisher. The replenisher was fed to the fixing tank in an amount of 200 ml every 8 quarter-size sheets of X-ray exposed photosensitive material being processed.

Results

Comparative Example 2 needed a large size storage tank having a volume of 25 liters to provide 15 liters of fixer replenisher whereas Example 1 used a small size storage tank having a total volume of 5.56 liters to provide the same volume of fixer replenisher.

The system of Example 2 was very easy to operate since the respective partial stocks can be transferred to the storage tank compartments by a single operation. The system of Comparative Example 2 required a cumbersome, time-consuming operation to admit the partial stocks into the storage tank because the partial stocks were filled in the separate bottles.

In Example 2, no variation in composition or concentration of the fixer replenisher occurred from the start to the end of replenishment.

Next, using the same automatic processor and processing stock kits as in Example 2, medical X-ray photosensitive materials Super HR-A(15), Super HR-S(100), Super Hr-L(60), and RX(40) and CRT image recording photosensitive materials MI-NC(20) and MI-SF(10) (all manufactured by Fuji Photo Film Corporation, the figures in the parentheses designate the proportion of their area) were processed in the common processor. The developing temperature was 32° C., the fixing temperature was 30° C., and the developing, fixing, washing, squeezing and drying times were 24.5, 21.7, 10.5, 12.2 and 14.7 seconds, respectively.

Operation was continued for 3 months at an average throughput of 200 sheets/day. No problem arose during the long-term processing for all the types of photosensitive material.

There has been described a method and system for replenishing a processing solution. Since partial stocks for the processing solution are stored as such in the storage tank, the storage tank and the overall system can be reduced in size. The operation of transferring the partial stocks into the storage tank is easy. When the invention is applied to an automatic processor, the storage tank is of a reduced volume so that the storage tank may be installed to the processor in a side-by-side relationship or within the processor, providing space saving and ease of handling advantages.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A method for replenishing a processing solution having a plurality of partial stocks diluted with a diluent to a processing tank, comprising the steps of:

providing a cartridge having discrete compartments partitioned therein and filled with the partial stocks in amounts corresponding to a desired mix proportion of the partial stocks, transferring the partial stocks from the cartridge compartments into discrete compartments partitioned in a storage tank, respectively, and delivering the partial stocks from the tank compartments in amounts corresponding to the desired mix proportion of the partial stocks to the processing tank along with the diluent.

2. The method of claim 1 in which the delivering step includes pumping partial stocks from the tank compartments and diluent water in amounts corresponding to the desired mix proportion and mixing the partial stocks with the diluent before the mixture is fed into the processing tank.

3. The method of claim 2 wherein the mixing step uses a static mixer.

4. The method of claim 1 wherein the transferring step includes dispensing the partial stocks from the cartridge compartments into the storage tank compartments in a chicken hopper manner, respectively.

5. The method of claim 1 which further includes the steps of:

detecting the level of the partial stocks in the storage tank compartments, and indicating a need for the replacement of the cartridge in response to the detected signal.

6. The method of claim 5 which further includes the step of controlling the delivery step and the indicating step such that the need for cartridge replacement is indicated when at least one of the detected levels of the partial stocks in the storage tank compartments is below a predetermined value.

7. The method of claim 6 which further includes the step of activating an alarm indicating the urgent need for the replacement of the cartridge.

8. A system for replenishing a processing solution having a plurality of partial stocks diluted with a diluent to a processing tank, comprising a cartridge having discrete compartments partitioned therein and filled with the partial stocks in amounts corresponding to a desired mix proportion of the partial stocks, a storage tank having discrete compartments partitioned therein, means for transferring the partial stocks from the cartridge compartments into the storage tank compartments, respectively, and means for delivering the partial stocks from the storage tank compartments in amounts corresponding to the desired mix proportion of the partial stocks to the processing tank along with the diluent.

9. The system of claim 8 in which the delivery means includes means for pumping partial stocks from the tank compartments and diluent water in amounts corresponding to the desired mix proportion.

10. The system of claim 9 wherein the delivery means further includes conduits extending from the storage tank compartments to the processing tank and the pumping means includes pumps located in the conduits.

11. The system of claim 10 wherein the pumps are bellows pumps.

12. The system of claim 9 in which the delivery means further includes means for mixing the partial stocks with the diluent before the mixture is fed into the processing tank.

13. The system of claim 12 wherein the mixing means is a static mixer.

14. The system of claim 8 wherein the transferring means includes chicken hopper means for continuously dispensing the partial stocks from the cartridge compartments into the storage tank compartments, respectively.

15. The system of claim 8 which further includes:

means for detecting the level of the partial stocks in the storage tank compartments, and indicator means for indicating the need for replacement of the cartridge in response to the detected signal.

16. The system of claim 15 which further includes means for controlling the delivery means and the indicator means such that the need for cartridge replacement is indicated when at least one of the detected levels of the partial stocks in the storage tank compartments is below a predetermined value.

17. The system of claim 16 which further includes means for providing an alarm indicating the urgent need for the replacement of the cartridge.

* * * * *